United States Patent [19]

Maekawa et al.

[11] Patent Number: 4,946,771

[45] Date of Patent: Aug. 7, 1990

[54] SILVER HALIDE PHOTOGRAPHIC MATERIAL

[75] Inventors: Yukio Maekawa; Tsumoru Hirano, both of Minami-ashigara, Japan

[73] Assignee: Fuji Photo Film Co., Ltd., Kanagawa, Japan

[21] Appl. No.: 414,215

[22] Filed: Sep. 28, 1989

Related U.S. Application Data

[63] Continuation-in-part of Ser. No. 172,528, Mar. 24, 1988, abandoned.

[30] Foreign Application Priority Data

Mar. 25, 1987 [JP] Japan ..... 62-71123

[51] Int. Cl.[5] ..... G03C 7/34; G03C 7/36; G03C 7/38; G03C 7/32

[52] U.S. Cl. ..... 430/548; 430/381; 430/627

[58] Field of Search ..... 430/548, 627, 381

[56] References Cited

U.S. PATENT DOCUMENTS

| | | | |
|---|---|---|---|
| 4,215,195 | 7/1980 | Ponticello et al. | 430/496 |
| 4,612,278 | 9/1986 | Lau et al. | 430/548 |
| 4,663,272 | 5/1987 | Nakamura | 430/548 |

FOREIGN PATENT DOCUMENTS

| | | |
|---|---|---|
| 0027284 | 4/1981 | European Pat. Off. . |
| 3233168 | 3/1983 | Fed. Rep. of Germany . |
| 5828744 | 2/1983 | Japan . |
| 2080559 | 2/1982 | United Kingdom . |

OTHER PUBLICATIONS

Research Disclosure, No. 188, Dec. 1979, pp. 703–708.

*Primary Examiner*—Richard L. Schilling
*Attorney, Agent, or Firm*—Sughrue, Mion, Zinn, Macpeak & Seas

[57] ABSTRACT

Photographic materials which comprise novel color photographic couplers are provided. The silver halide color photographic material is improved in sharpness and prevention against the mixing of colors.

13 Claims, No Drawings

SILVER HALIDE PHOTOGRAPHIC MATERIAL

This is a continuation-in-part of application Ser. No. 172,528, filed Mar. 24, 1988, now abandoned.

BACKGROUND OF THE INVENTION (1) Field of the Invention

The present invention relates to photographic materials which comprise novel color photographic couplers.

(2) Description of the Prior Art

After a silver halide photographic material is exposed to light, when it is color-developed, the oxidized primary amine developing agent reacts with dye-forming couplers to form a color image. Generally, in this technique, color reproduction is effected by a substractive color process in which to reproduce blue, green and red, complementary color images of yellow, magenta, and cyan are formed.

As yellow dye image-forming agents, for example, acylacetanilide or benzoylmethane-type couplers are used., as magenta dye image-forming agents, for example, pyrazolone, pyrazolotriazole, pyrazolobenzimidazole, cayanozcetophenone or indazolone-type couplers are used; and as cyan dye forming agents, for example, phenol or naphthol-type couplers are used.

In multi-layer color photographic materials, to lessen color mixing, which the color reproduction, it is necessary to secure the couplers in their respective separate layers, thereby rendering them fast to diffusion. To render couplers fast to diffusion, many techniques have been used.

One method introduces a long-chained aliphatic group into the molecule of couplers to prevent diffusion. The couplers used in this technique are immiscible with aqueous gelatin solutions. Therefore, it is necessary, as disclosed in U.S. Pat. No. 2,322,027, that for the coating the couplers are dissolved in a high-boiling solvent and emulsified and dispersed into an aqueous gelatin solution.

However, in such a method, to improve the sharpness of the dye image by reducing the thickness of the coupler-containing layer, if the amount of a high-boiling organic solvent is decreased, the coupler is liable to crystallize out in the emulsion layer. It is therefore necessary to use a certain amount or more of a high-boiling organic solvent, and it is difficult to improve the sharpness of the dye image by sufficiently reducing the thickness of the coupler-containing layer. Further, if a high-boiling organic solvent is used, a large amount of gelatin is required because the coupler-containing layer is softened. As a result, the sharpness of the dye image degrades disadvantageously.

Other techniques to render couplers fast to diffusion include polymerizing the couplers. Known polymerizing polymers are lipophilic polymer couplers and hydrophilic polymer couplers.

A lipophilic polymer coupler may be prepared by emulsifying and dispersing a lipophilic polymer coupler dissolved in an organic solvent, obtained by the polymerization of a monomer coupler, into an aqueous gelatin solution to be made in the form of a latex, or it may be prepared directly by emulsion polymerization.

As a method to emulsify and disperse a lipophilic polymer coupler into an aqueous gelatin solution to be made in the form of a latex, use can be made of a method described in U.S. Pat. No. 3,451,820, and for emulsion polymerization, use can be made of methods described in U.S. Pat. Nos. 4,080,211 and 3,370,952.

However, when lipophilic polymer couplers are emulsified and dispersed into an aqueous gelatin solution to be made in the form of a latex, the coupler-containing layer is softened, similar to emulsification and dispersion, wherein a long-chain aliphatic group is introduced into the coupler molecule. As a result, a large amount of gelatin is required, thus increasing the thickness of the coupler containing layer. It is therefore difficult to adequately improve the sharpness of a dye image by using a lipophilic polymer coupler.

On the other hand, when using hydrophilic polymer couplers, since the hydrophilic polymer can be dispersed uniformly into a gelatin layer, the coupler-containing layer is less softened. It is therefore possible to decrease the thickness of the coupler layer by using a small amount of gelatin.

For example, polymer couplers that are prepared by joining reactive couplers to synthesized polymers (e.g., acrylic acid homopolymcrs and p-aminostyrene homopolymers) or natural high polymer compounds (e.g., gelatin) are described in U.S. Pat. Nos. 2,698,797, 2,852,381, 2,852,383, and 2,870,712, and Japanese Patent Publication Nos. 16932/1960 and 3661/1969, and polymer couplers that are prepared by copolymerizing couplers synthesized in the form of ethylenically-unsaturated monomers with other polymerizable monomers are disclosed in British Pat. Nos. 880,206, 955,197, 967,503, 967,504, 995,363, and 1,104,658. However, the above-described hydrophilic polymer couplers are not adequately fast to diffusion and they are also liable to allow colors to mix. Further, in the worst cases, the couplers disadvantageously flow out during the development processing. To overcome this, hydrophilic polymer couplers having phenolic hydroxyl groups or active methylene groups have been suggested in U.S. Pat. Nos. 4,207,109. 4,215,195, and 4,421,915, and Japanese Patent Application (OPI) No. 27139/1983 and 28744/1983. However, polymers of this type are still not adequately fast to diffusion, and the obtained dye images are low in density.

BRIEF SUMMARY OF THE INVENTION

The first object of the invention is to provide a novel polymer coupler for silver halide color photographic materials.

The second object of the invention is to provide a novel polymer coupler adequately fast to diffusion to be secured in a gelatin layer in which it is dispersed.

The third object of the invention is to provide a silver halide color photographic material improved in sharpness and prevention against the mixing of colors.

The fourth object of the invention is to provide a silver halide color photographic material containing a novel polymer coupler.

Other and further objects, features, and advantages of the invention will appear more fully from the following description.

DETAILED DESCRIPTION OF THE INVENTION

To attain the above objects and overcome the disadvantages of the prior polymer couplers, the inventors have found that the solubility of polymer couplers in water and the ability to lower the surface tension of water affect the fastness to diffusion, the sharpness, etc., and this invention has been made based upon these findings.

Therefore, the present invention provides a silver halide photographic material which comprises, as a photographic color coupler, a water-soluble polymer coupler that can couple with the oxidized product of an aromatic primary amine developing agent to form a dye, and said coupler has the ability to lower the surface tension of water, wherein the polymer coupler is selected from those with repeating units represented by the following formula (1) or those represented by the following formula (II):

$$-(Qa)_{x_1}(A)_y(B)_z- \quad (I)$$

$$G-(Qa)_{x_2}(B)_zX \quad (II)$$

wherein Qa represents an ethylenically-unsaturated monomer unit having a coupler residue that can couple with the oxidized product of an aromatic primary amine developing agent, A represents a monomer unit derived from a copolymerizable ethylenically-unsaturated monomer that has a fluorine-atom-containing substituent; B represents a monomer unit derived from a copolymerizable ethylenically-unsaturated monomer; $x_1$ is 10 to 98 wt. %, $x_2$ is 10 to 100 wt. %, y is 2 to 80 wt. %, and z is 0 to 80 wt. %.; A and B do not include a coupler residue; X represents a monovalent group; and G in formula (II) is represented by the following formula (XXV):

$$G^1-(L)_l- \quad (XXV)$$

wherein $G^1$ is an alkyl group, a substituted alkyl group, a substituted aryl group, and a substituted naphthyl group, each having 8 or more carbon atoms;

L represents —O—, —S—, —SO—, or —$SO_2$—, and l is 0 or 1.

Qa represents a unit derived from an ethylenically-unsaturated monomer having a coupler residue that can coupler with the oxidized product of an aromatic primary amine developing agent, and typical units represented by Qa can be derived from monomers represented by the following formula (III):

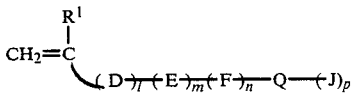

(III)

wherein $R^1$ represents a hydrogen atom, a chlorine atom, or an alkyl. group having 1 to 4 carbon atoms; D represents —COO—, —CONR'—, or a substituted or unsubstituted phenyl group; E represents a substituted or unsubstituted alkylene group having preferably 1 to 30 carbon atoms, phenylene group having preferably 6 to 30 carbon atoms, or aralkylene group having preferably 7 to 30 carbon atoms; F represents —CONR'—, —NR'—CONR'—, —NR'COO—, —NR'CO—, —OCONR'—, —NR'—, —COO—, —OCO—, —CO—, —O—, —$SO_2$, —NR'$SO_2$—, or —$SO_2$NR'—, in which R' represents a hydrogen atom or a substituted or unsubstituted aliphatic group or aryl group, and if two or more R' are present in the same molecule, they may be the same or different, R' is preferably an alkyl group having 1 to 30 carbon atoms or a phenyl group having 6 to 30 carbon atoms;

l, m, and n are 0 or 1, provided that l, m and n are not 0 at the same time;

J represents a hydrophilic group, for example preferably —COOM, —$SO_3$M, —O—$SO_3$M, and

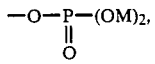

in which M represents a hydrogen atom or an inorganic or organic cation., p is 0, 1 or 3; and Q represents a cyan, magenta, or yellow dye-forming coupler residue capable of coupling with the oxidized product of an aromatic primary amine developing agent to form a dye.

Of the dye-forming coupler residues represented by Q, as cyan dye-forming coupler residues, those of phenol type (IV) or (VI) or naphthol type (V) or (VII) are preferable (a hydrogen atom positioned at other than the coupling position or the 1-positioned OH group will split off to join F and J of formula (III)).

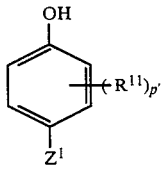

(IV)

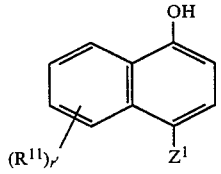

(V)

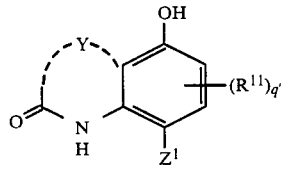

(VI)

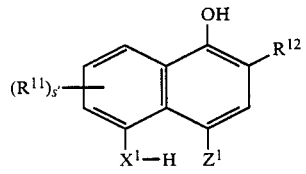

(VII)

wherein $R^{11}$ represents a group capable of replacing on a phenol ring or a naphthol ring such as a halogen atom, a hydroxy group, an amino group, a sulfo group, a cyano group, an aliphatic group, an aromatic group, a heterocyclic group, a carbonamido group, a sulfonamido group, a carbamoyl group, a sulfamoyl group, an acyloxy group, an acyl group, an aliphatic oxy group, an aliphatic sulfonyl group, an aromatic oxy group, an aromatic thio group, an aromatic sulfonyl group, a sulfamoylamino group, a nitro group, and an imido group, with $R^{11}$ having 0 to 3 carbon atoms, $R^{12}$, represents —$CONR^{13}R^{14}$, —$NHCOR^{13}$, —$NHCOOR^{15}$, —$NHSO_2R^{15}$, —$NHCONR^{13}R^{14}$, or —$NHSO_2R^{13}R^{14}$ in which $R^{13}$ or $R^{14}$ represents a hydrogen atom, an aliphatic group having 1 to 30 carbon atoms (e.g., methyl, ethyl, butyl, methoxyethyl, n-decyl, n-dodecyl, n-hexadecyl, trifluoromethyl, heptafluoropropyl, dodecyloxypropyl, 2,4-di-tertamylphenoxypropyl, and 2,4-di-tert-amylphenoxybutyl), an aromatic group having 6 to 30 carbon atoms (e.g., phenyl, tolyl, 2-tetradecyloxyphenyl, pentafluorophenyl, and 2-chloro-5-dodecyloxycarbonylphenyl), or a heterocyclic group having 2 to 30 carbon atoms (e.g., 2-pyridyl, 4-pyridyl, 2-furyl, and 2-thienyl), $R^{15}$ represents an aliphatic group having 1 to 30 carbon atoms (e.g., methyl, ethyl, butyl, dodecyl, and hexadecyl), an aromatic group having 6 to 30 carbon atoms (e.g., phenyl, tosyl, 4-chlorophenyl, and naphthyl), or a heterocyclic group (e.g., 4-pyridyl, quinolyl, and 2-furyl), and $R^{13}$ and $R^{14}$ may bond together to form a heterocyclic ring (e.g., morpholine, piperidine, and pyrrolidinc), p' is a integer of 0 to 3, q' is a integer of 0 to 2, r' and s' are each integers of 0 to 4, $X^1$ represents an oxygen atom, a sulfur atom, or $R^{16}N<$, in which $R^{16}$ represents a hydrogen atom or a monovalent group such as an aliphatic group having 1 to 30 carbon atoms (e.g., methyl, ethyl, butyl, methoxyethyl, and benzyl), an aromatic group having 6 to 30 carbon atoms (e.g., phenyl, and tolyl), a heterocyclic group having 2 to 30 carbon atoms (e.g., 2-pyridyl, and 2-pyrimidyl), a carbonamido group having 1 to 30 carbon atoms (e.g., formamido, acetamido, N-methylacetamido, and benzamido), a sulfonamido group having 1 to 30 carbon atoms (e.g., methanesulfonamido, toluenesulfonamido, and 4-chlorobenzenesulfonamido), an imido group having 4 to 30 carbon atoms, —$OR^{17}$, —$SR^{17}$—, —$COR^{17}$, —$CONR^{17}R^{18}$, —$COCOR^{17}$, —$COCONR^{17}R^{18}$, —$COOR^{19}$, —$COCOOR^{19}$, —$SO_2R^{19}$, —$SO_2OR^{19}$, —$SO_2NR^{17}R^{18}$, and —$NR^{17}R^{18}$, in which $R^{17}$ and $R^{18}$, which may be the same or different, each represent a hydrogen atom, an aliphatic group having 1 to 30 carbon atoms (e.g., methyl, ethyl. butyl dodecyl methoxyethyl ethyl, trifluoromethyl. and heptafluoropropyl), an aromatic group having 6 to 30 carbon atoms (e.g., phenyl, tolyl, 4-chlorophenyl, pentafluorophenyl, 4-cyanophenyl, and 4-hydroxyphenyl), or a heterocyclic group having 2 to 30 carbon atoms (e.g., 4-pyridyl, 3-pyridyl, and 2-furyl), and $R^{17}$ and $R^{18}$ may bond together to form a heterocyclic ring (e.g., a morpholino group, and a pyrrolidine group), and as examples of $R^{19}$ can be mentioned substituents defined for $R^{17}$ and $R^{18}$, excluding a hydrogen atom, $Z^1$ represents a hydrogen atom, or a group that can split off by the coupling reaction with the oxidized product of an aromatic primary amine developing agent. As examples that can split off can be mentioned a halogen atom (e.g., fluorine, chlorine, bromine, and iodine), an aliphatic oxy group having 1 to 30 carbon atoms (e.g., methoxy, ethoxy, 2-hydroxyethoxy. 2-methoxyethoxycarbamoylmethyloxy, 2-methanesulfonylethoxy, and triazolylmethyloxy), an aromatic oxy group having 6 to 30 carbon atoms (e.g., phenoxy, 4-hydroxyphenoxy, 2-acetoamidophenoxy, 2,4-dibenzenesulfonamidophenoxy, and 4-phenylazophenoxy), a heterocyclic oxy group having 2 to 30 carbon atoms (e.g., 4-pyridyloxy and 1-phenyl-5-tetrazolyloxy), an aliphatic thio group having 1 to 30 carbon atoms (e.g., dodecylthio), an aromatic thio group having 6 to 30 carbon atoms (e.g., 4-dodecylphenylthio), a heterocyclic thio group having 2 to 30 carbon atoms (e.g., 4-pyridylthio and 1-phenyltetrazol-5-ylthio), an acyloxy group having 2 to 30 carbon atoms (e.g., acetoxy, benzoyloxy, and lauroyloxy), a carbonamido group having 1 to 30 carbon atoms (e.g., dichloroacetylamido, trifluoroacetamido, pentafluorobutaneamido, and pentafluorobenzamido), a sulfonamido group having 1 to 30 carbon atoms (e.g., methanesulfonamido, and toluenesulfonamido), an aromatic azo group having 6 to 30 carbon atoms (e.g., phenylazo, 4-chlorophenylazo, 4-methoxyphenylazo, and 4-pivaloylaminophenylazo), an aliphatic oxycarbonyloxy group having 1 to 30 carbon atoms (e.g., ethoxycarbonyloxy, and dodecyloxycarbonyloxy), an aromatic oxycarbonyloxy group having 6 to 30 carbon atoms (e.g., phenoxycarbonyloxy), a carbamoyloxy group having 1 to 30 carbon atoms (e.g., methylcarbamoyloxy, dodecylcarbamoyloxy, and phenylcarbamoyloxy), and a heterocyclic group having 1 to 30 carbon atoms and connected to the active position of the coupler through the nitrogen atom (e.g., succinimido, phthalimido, hydantoinyl, pyrazolyl, and 2-benzotriazolyl).

The couplers represented by general formulas (IV), (V), (VI), and (VII) may be combined themselves at the substituent $R^{11}$, $R^{12}$, $X^1$ or $Z^1$ via a divalent or higher valent linking group to become a dimer or higher polymer.

Of color-forming coupler residues represented by Q, preferred magenta dye-forming coupler residues are those represented by general formula (VIII), (IX), (X), (XI), (XII), (XIII), and (XIV), and they are connected to D, E or F of formula (III) at any part of Ar, $Z^2$, and $R^{20}$ to $R^{32}$

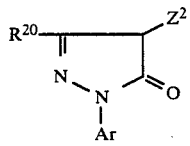
Formula (VIII)

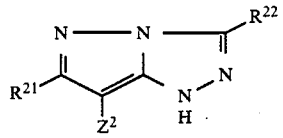
Formula (IX)

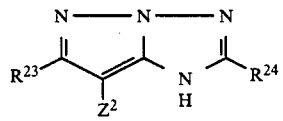
Formula (X)

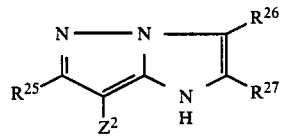
Formula (XI)

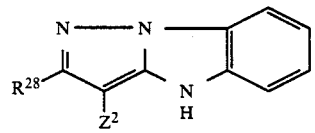
Formula (XII)

-continued

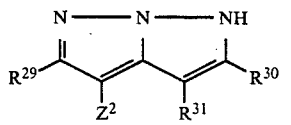

Formula (XIII)

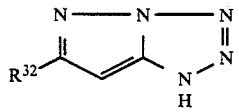

Formula (XIV)

wherein Ar represents a known substituent at the first position of a 2-pyrazoline-5-on coupler, for example an unsubstituted or substituted alkyl group (e.g., haloalkyl such as fluoroalkyl, cyanoalkyl, and benzylalkyl; an unsubstituted or substituted aryl group [examples of the substituted are an alkyl group (e.g., methyl and ethyl), alkoxy group (e.g., methoxy and ethoxy), aryloxy group (e.g., phenyloxy), alkoxycarbonyl group (e.g., methoxycarbonyl), acylamino group (e.g., acethylamino), carbamoyl group, alkylcarbamoyl group (e.g., methylcarbamoyl and ethylcarbamoyl), dialkylcarbamoyl group (e.g., dimethylcarbamoyl), arylcarbamoyl group (e.g., phenylcarbamoyl), alkylsulfonyl group (e.g., methanesulfonyl), arylsulfonyl group (e.g., phenylsulfonyl), alkylsulfonamido group (e.g., methanesulfonamido), arylsulfonamido group (e.g., phenylsulfonamido), sulfamoyl group, alkylsulfamoyl group (e.g., ethylsulfamoyl), dialkylsulfamoyl group (e.g., dimethylsulfamoyl), alkylthio group (e.g., methylthio), arylthio group (e.g., phenylthio), cyano group, nitro group, and halogen atom (e.g., fluorine, chlorine, and bromine): When the substituents are two or more in number, they may be same or different, and particularly preferred examples of substituents are a halogen atom, alkyl group, alkoxy group, an alkoxycarbonyl group, and cyano group]., or a heterocyclic group (e.g., triazole, thiazole, benzthiazole, furan, pyridinc, quinaldine, benzoxazole, pyrimidine, oxazole, and imidazole).

$R^{20}$ represents an unsubstituted or substituted anilino group, an unsubstituted or substituted acylamino group (e.g., alkylcarbonamido, phenylcarbonamido, alkoxycarbonamido, and phenyloxycarbonamido), or an unsubstituted or substituted ureido group (e.g., alkylureido and phenylureido); Example substituents of these substituted groups are a halogen atom (e.g., fluorine, chlorine, and bromine), straight-chain or branched-chain alkyl group (e.g., methyl, t-butyl, octyl, and tetradecyl), alkoxy group (e.g., methoxy. ethoxy, 2-ethylhexyloxy, and tetradecyloxy), acylamino group (e.g., acetamido, benzamido, butaneamido, octaneamido, tetradecaneamido, α-(2,4-di-tertamylphenoxy)acetoamido, α-(2,4-di-tert-amylphenoxy)-butylamido, α-(3-pentadecylphenoxy)hexaneamido, α-(4-hydroxy-3-tert-butylphenoxy)tetradecaneamido, 2-oxo-pyrrolidine-1-yl, 2-oxo-5-tetradecylpyrrolidine-1-yl, and N-methyl tetradecaneamido). sulfonamido group (e.g., methanesulfonamido, benzencsulfonamido, ethylsulfonamido, p-toluenesulfonamido, octanesulfonamido, p-dodecylbenzenesulfonamido, and N-methyl-tetradecanesulfonamido), sulfamoyl group (e.g., sulfamoyl, N-methyl-sulfamoyl, N-ethylsulfamoyl, N,N-dimethylsulfamoyl, N,N-dihexylsulfamoyl, N-hexadecylsulfamoyl, N-[3-(dodecyl)-propyl]sulfamoyl, N-[4-(2,4-di-tert-amylphenoxy)butyl]-sulfamoyl, and N-methyl-N-tetradecylsulfamoyl), carbamoyl group (e.g., N-methylcarbamoyl, N-butylcarbamoyl, N-octadecylcarbamoyl, N-[4-(2,4-di-tert-amylphenoxy)butyl]-carbamoyl, and N-methyl-N-tetradecylcarbamoyl), diacylamino group (N-succinimido, N-phthalimido, 2,5-dioxo-1-hydantoinyl, and 3-(N-acetyl-N-dodecylamino)succinimido), alkoxycarbonyl group (e.g., methoxycarbonyl, tetradecyloxycarbonyl, and benzyloxycarbonyl), alkoxysulfonyl group (e.g., methoxysulfonyl, butoxysulfonyl, octyloxysulfonyl, and tetradecyloxysulfonyl), aryloxysulfonyl group (e.g.,phenoxysulfonyl, p-methylphenoxysulfonyl, and 2,4-di-tertamylphenoxysulfonyl), alkanesulfonyl group (e.g., methanesulfonyl, ethanesulfonyl, octanesulfonyl, 2-ethylhexylsulfonyl, and hexadecanesulfonyl), arylsulfonyl group (e.g., benzenesulfonyl and 4-nonylbenzenesulfonyl), alkylthio group (e.g., methylthio, ethylthio, hexylthio, benzylthio, tetradecylthio, and 2-(2,4-di-tertamylphenoxy)ethylthio), arylthio group (e.g., phenylthio and p-trylthio), alkyl-oxycarbonylamino group (e.g., methoxycarbonylamino, ethyloxycarbonylamino, benzyloxycarbonyl, and hexadecyloxycarbonylamino), alkylureido group (e.g., N-methylureido, N,N-dimethylureido, N-methyl-N-dodecylureido, N-hexadecylureido, and N,N-dioctadecylureido), acyl group (e.g., acetyl, benzoyl, octadecanoyl, and p-dodecaneamidobenzoyl), nitro group, carboxyl group, sulfo group, hydroxyl group, or trichloromethyl group.

Of the above-mentioned substituents, the number of carbon atoms of a substituent defined as an alkyl group is 1 to 36, and that defined as an aryl group is 6 to 38.

$R^{21}$, $R^{22}$, $R^{23}$, $R^{24}$, $R^{25}$, $R^{26}$, $R^{27}$, $R^{28}$, $R^{29}$, $R^{30}$, $R^{31}$, and $R^{32}$ each represent a hydrogen atom, hydroxyl group, unsubstituted or substituted alkyl group (wherein the number of carbon atoms is preferably 1 to 20, e.g., methyl, propyl, t-butyl, trifluoromethyl, and tridecyl), unsubstituted or substituted aryl group (wherein the number of carbon atoms is preferably 6 to 20, e.g., phenyl, 4-t-butylphenyl 2,4-dit-amylphenyl, and 4-methylphenyl), unsubstituted or substituted heterocyclic group (e.g., 2-furyl, 2-thienyl, 2-pirimidinyl, and 2-benzothiazolyl), alkylamino group (wherein the number of carbon atoms is preferably 1 to 20, e.g.. methylamino, diethylamino, and t-butylamino), acylamino group (wherein the number of carbon atoms is preferably 2 to 20, e.g., acetylamino, propylamino, and benzamino), anilino group (e.g., phenylanilino and 2-chloroanilino), alkoxycarbonyl group (wherein the number of carbon atoms is preferably 2 to 20, e.g., methoxycarbonyl, butoxycarbonyl, and 2-ethylhexyloxycarbonyl), alkylcarbonyl group (wherein the number of carbon atoms is preferably 2 to 20, e.g., acetylcarbonyl, butylcarbonyl, and cyclohexylcarbonyl), arylcarbonyl group (wherein the number of carbon atoms is preferably 7 to 20, e.g., benzoyl and 4-t-butylbenzoyl), alkylthio group (wherein the number of carbon atoms is preferably 1 to 20, e.g., methylthio, octylthio, and 2-phenoxyethylthio), arylthio group (wherein the number of carbon atoms is preferably 6 to 20, e.g., phenylthio and 2-butoxy-5-t-octylphenylthio), carbamoyl group (wherein the number of carbon atoms is preferably 1 to 20, e.g., N-ethylcarbamoyl, N,N-dibutylcarbamoyl, and N-methyl-N-butylcarbamoyl), sulfamoyl group (wherein the number of carbon atoms is preferably 20 or below, e.g., N-ethylsulfamoyl, N,N-di-ethylsulfamoyl, and N,N-dipropylsulfamoyl), or sulfonamido group (wherein the number of carbon atoms is preferably 1 to 20, e.g., methanesulfonamido, benzenesulfonamido, and p-toluenesulfonamido).

$Z^2$ represents a hydrogen atom or a group which can split-off upon a coupling-reaction with the oxidation product of an aromatic primary amine developing agent. Examples of such coupling split-off groups include a halogen atom (e.g., chlorine atom and bromine atom), a coupling split-off group connected through the oxygen atom (e.g., acetoxy, propanoyloxy, benzoyloxy, ethoxyoxazoyloxy, pyruvinyloxy, cinnamoyloxy, phenoxy, 4-cyanophenoxyl, 4-titaniumsulfonamidophenoxy, α-naphthoxy, 4-cyanoxyl, 4-methanesulfonamido-phenoxy, 3-pentadecylphenoxy, benzyloxycarbonyloxy, ethoxy, 2-cyanoethoxy, benzyloxy, 2-phenethyloxy, 2-phenoxy-ethoxy, 5-phenyltetrazoyloxy, and 2-benzothiazolyloxy), a coupling split-off group connected through the nitrogen atom (e.g., the groups described in Japanese Patent Application (OPI) No. 189538/1982 or benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolydinyl, 1-benzyl-5-ethoxy-3-hydantoinyl, 2-oxo-1,2-dihydro-1-pyrizonyl, imidazolyl, pyrazolyl, 3,5-diethyl-1,2,4-triazole-1-yl, 5- or 6-bromobenzotriazole-1-yl, 5-methyl-1,2,3,4-triazole-1-yl, and benzimidazolyl), and a coupling split-off group connected through the sulfur atom (e.g., phenylthio, 2-carboxyphenylthio, 2-methoxy-5-octylphenylthio, 4-methanesulfonylphenylthio, 4-octanesulfonamidophenylthio, benzylthio, 2-cyanoethylthio, 5-phenyl-2,3,4,5-tetrazoylthio, and 2-benzothiazolyl). Preferred examples of coupling split-off groups include a halogen atom, phenoxy group, and a coupling split-off group connected through the nitrogen atom. Particularly preferred examples include a halogen atom, phenoxy group, pyrazolyl group, imidazolyl group, and triazolyl group.

Of the residues of dye-forming coupler, as residues of yellow dye-forming couplers, those represented by formulas (XV) and (XVI) are preferable (connected to F or J in the above-mentioned formula (III) at a point of $Z^3$, $R^{33}$, $R^{34}$, $R^{35}$ or $R^{36}$).

(XV)

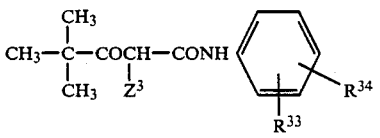

(XVI)

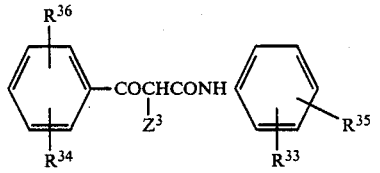

wherein $R^{33}$, $R^{34}$, $R^{35}$, and $R^{36}$, which may be the same or different each represent a hydrogen atom or a known substituent of the residue of yellow color-forming coupler (e.g., alkyl, alkenyl, alkoxy, alkoxycarbonyl, halogen atom. alkoxycarbamoyl, aliphatic amino, alkylsulfamoyl, alkylsulfonamido, alkylureido, alkyl-substituted succinimido, aryloxy, aryloxycarbonyl, arylcarbamoyl, arylamino, arylsulfamoyl, arylsulfonamido, arylureido, carboxyl, sulfo, nitro, cyano, and thiocyano).

$Z^3$ represents a hydrogen atom or a group represented by the following formulas (XVII), (XVIII), (XIX), or (XX).

(XVII)

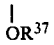

wherein $R^{37}$ represents an aryl group or heterocyclic group which may be substituted.

(XVIII)

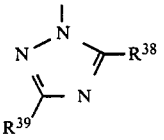

(XIX)

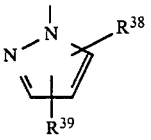

wherein $R^{38}$ and $R^{39}$, which may be the same or different, each represent a hydrogen atom, halogen atom ester group of calboxylate, amino group, alkyl group, alkylthio group, alkoxy group, alkylsulfonyl group, alkylsulfinyl group, carboxylic group, sulfon group, unsubstituted or substituted phenyl or heterocyclic group.

(XX)

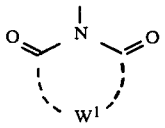

wherein $W^1$ represents a non-metal atom necessary to form a 4- or 5-membered ring with

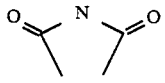

in the formula.

Preferred examples of compounds represented by formula (XX) include those represented by the following formulas (XXI)–(XXIII):

(XXI)

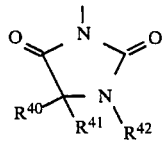

(XXII)

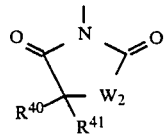

-continued (XXIII)

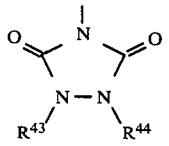

wherein $R^{40}$ and $R^{41}$ each represent a hydrogen atom, alkyl group, aryl group, alkoxy group, aryloxy group, or hydroxyl group; $R^{42}$, $R^{43}$, and $R^{44}$ each represent a hydrogen atom, alkyl group, aryl group, alalkyl group, or acyl group; and $W_2$ represents an oxygen atom or sulfur atom.

Specific examples of monomer represented by formula (III) are given below, but the invention is not limited to them.

QaM-1

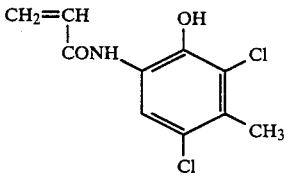

QaM-2

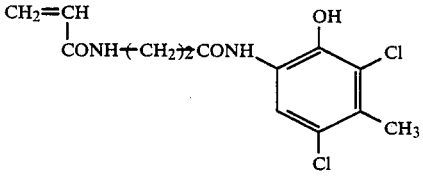

QaM-3

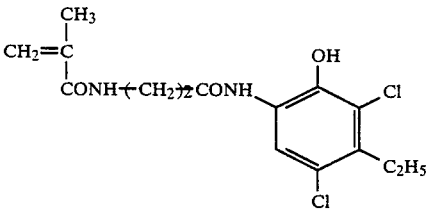

QaM-4

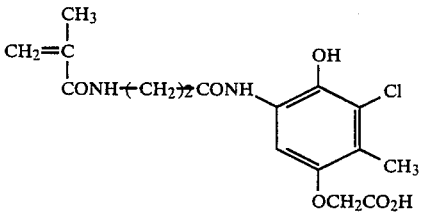

QaM-5

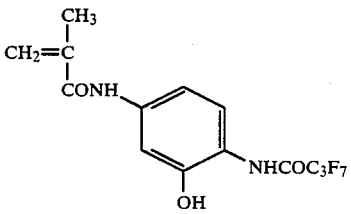

-continued

QaM-6

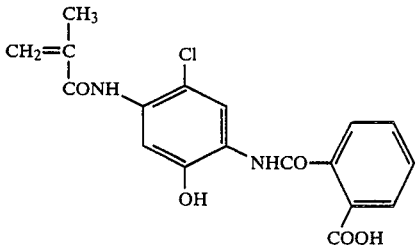

QaM-7

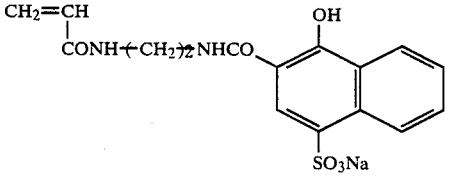

QaM-8

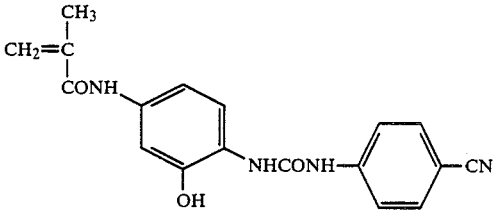

QaM-9

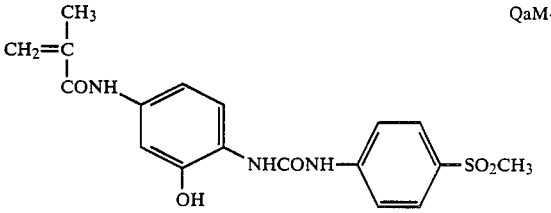

QaM-10

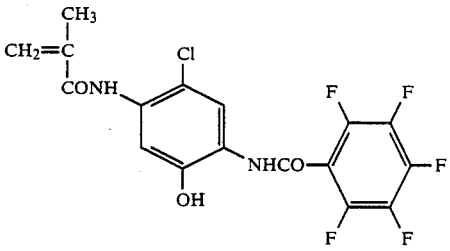

QaM-11

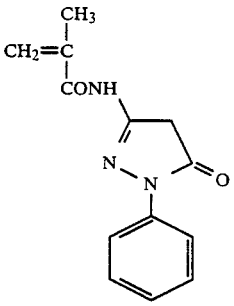

-continued
QaM-12
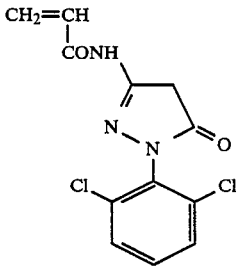
QaM-13
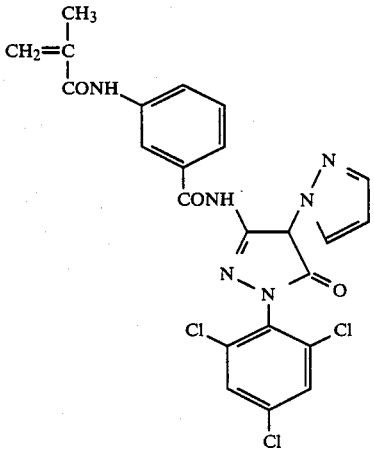
QaM-14
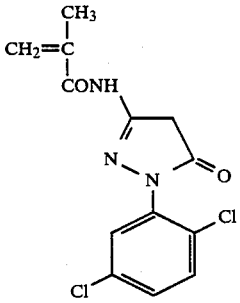
QaM-15
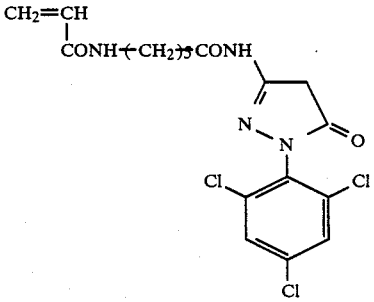
QaM-16
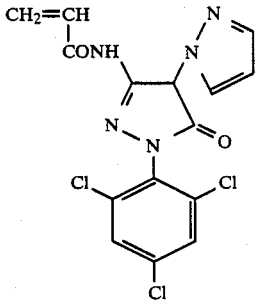
-continued
QaM-17
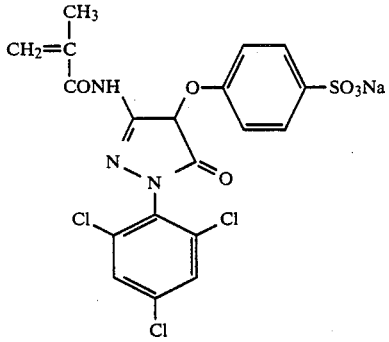
QaM-18
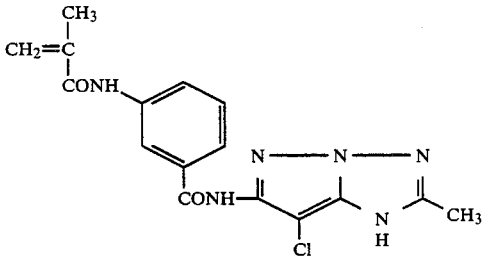
QaM-19
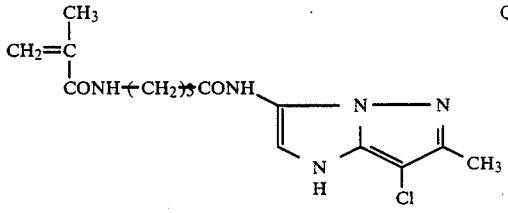
QaM-20
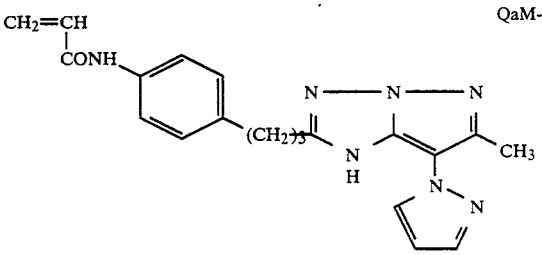
QaM-21
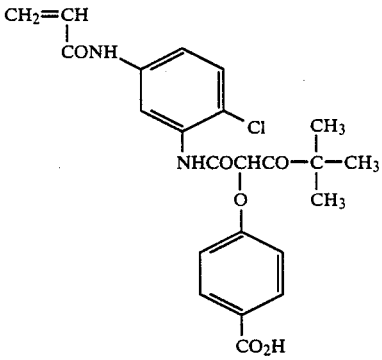
QaM-22
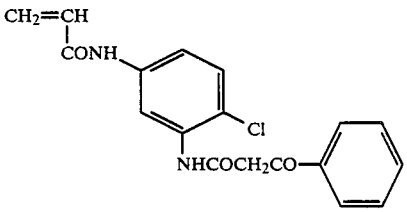

-continued

QaM-23

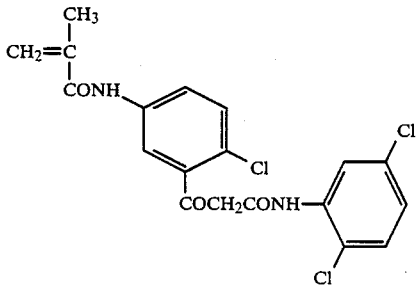

QaM-24

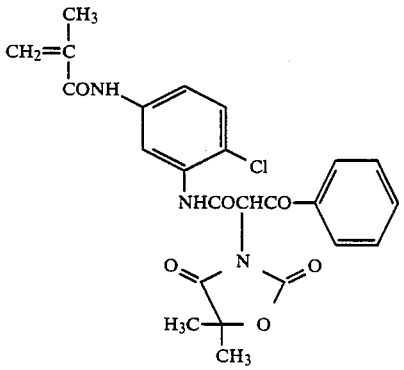

QaM-25

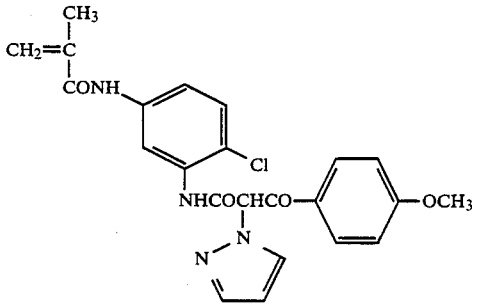

QaM-26

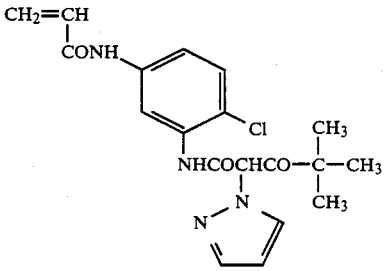

QaM-27

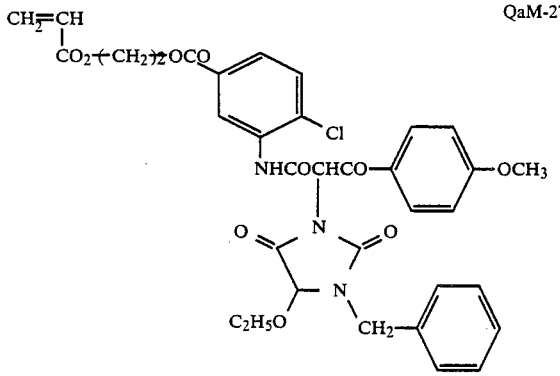

-continued

QaM-28

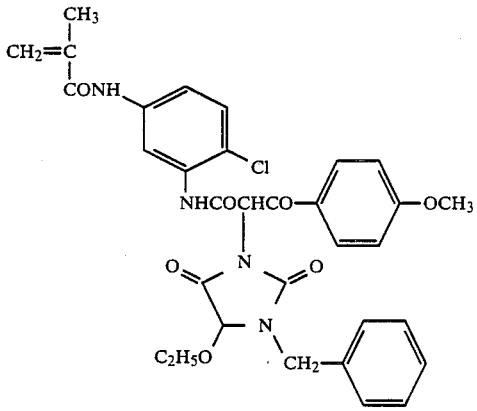

QaM-29

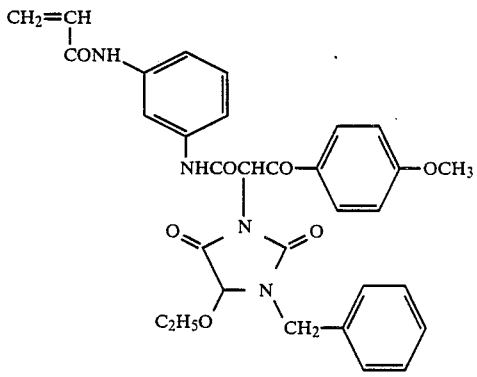

QaM-30

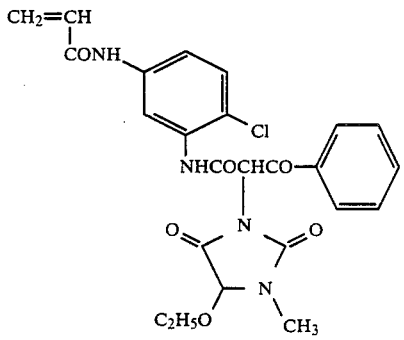

In the formula(I), A represents a monomer unit derived from a copolymerizable ethylenically-unsaturated monomer that has a fluorine-atom-containing substituent, and two or more types of such monomer units may be present. Of these monomer units, preferable ones can be derived from monomer units represented by the following formula (XXIV):

(XXIV)

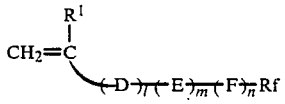

wherein $R^1$, D, F, l, m, and n have the same meanings as defined for formula (III) and $R_f$ represents an alkyl group, an aralkyl group, an aryl group, or an alkylaryl group, each having 1 to 30 carbon atoms and being replaced at least one of the hydrogen atoms with a fluorine atom.

Preferable examples of monomers represented by formula (XXIV) are shown below, but the invention is not limited to them.
AM-1
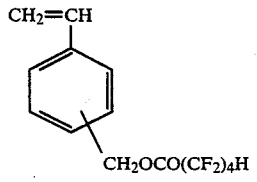
AM-2
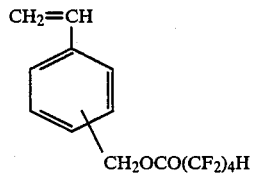
AM-3
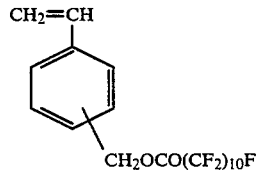
AM-4
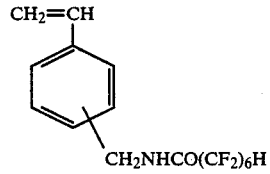
AM-5
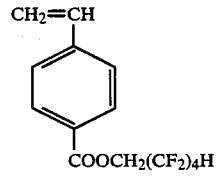
AM-6
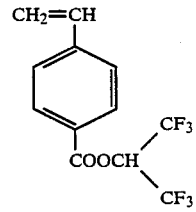
AM-7
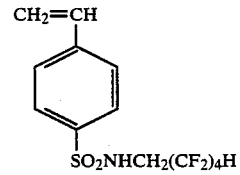
AM-8
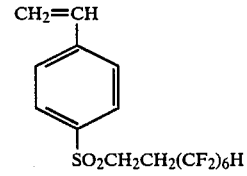
-continued
AM-9
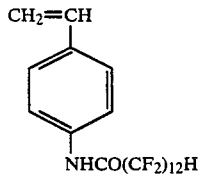
AM-10
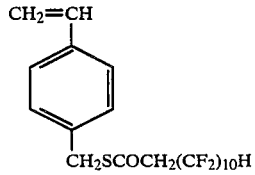
AM-11
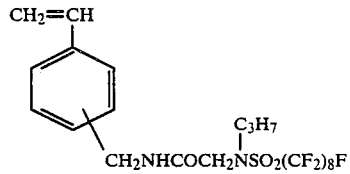
AM-12
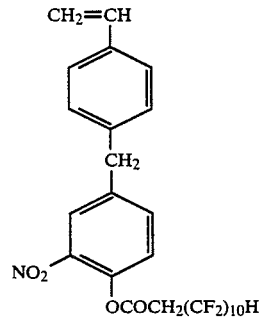
AM-13
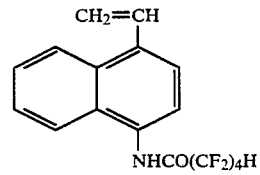
AM-14
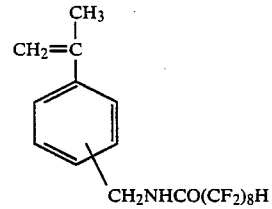
AM-15
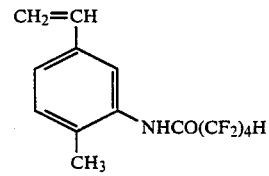

-continued
AM-16
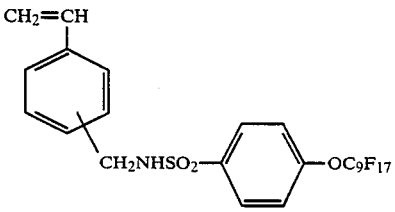
AM-17
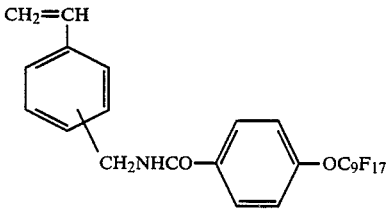
AM-18
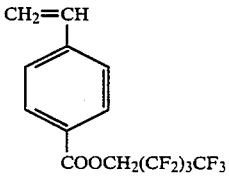
AM-19
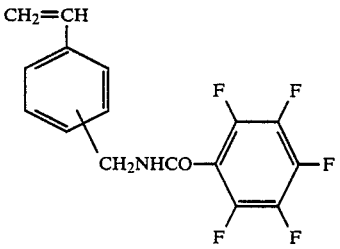
AM-20
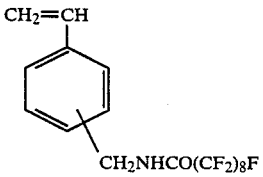
AM-21
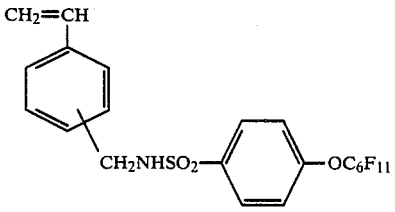
AM-22
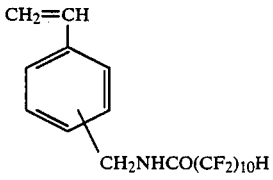
-continued
AM-23
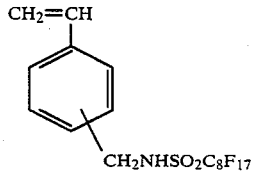
AM-24
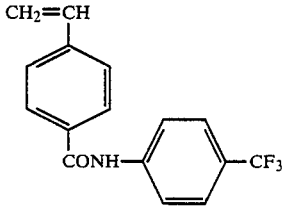
AM-25
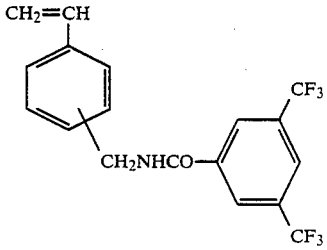
AM-26
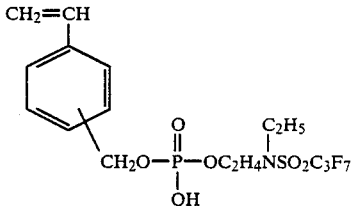
AM-27
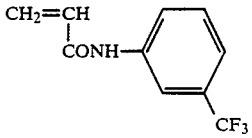
AM-28
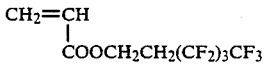
AM-29
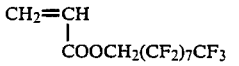
AM-30
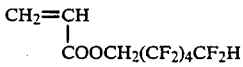
AM-31
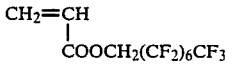
AM-32
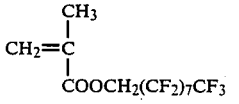
AM-33
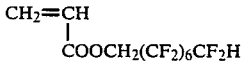

-continued

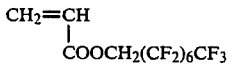

AM-34

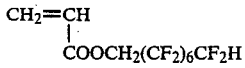

AM-35

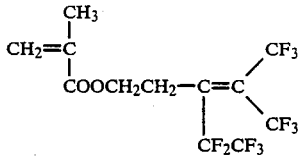

AM-36

In formulas (I) and (II), B represents a monomer unit derived from a copolymerizable ethylenically-unsaturated monomer, and two or more such monomer units may be present. Although, B is preferably a water-soluble monomer, it may partially contain a sparingly-soluble-in-water monomer. Typical examples of water-soluble monomers include nonionic monomers such as acrylamide, methacrylamide, N-methylolacrylamide, N,N-dimethylaminoethylacrylamide, N,N-dimethylaminopropylacrylamide, hydroxyethyl methacrylate, N,N-dimethylaminoethyl acrylate, N,N-dimethylaminoethyl methacrylate, poly(ethyleneoxy)acrylate, poly(ethyleneoxy)methacrylate, 2-vinylpyridine, 4-vinylpyridine, 1-vinyl-2-pyrrolidone, 1-vinylimidazole, and 1-vinyl-2-methylimidazole, cationic monomers such as vinylbenzyltrimethyl-ammonium salt, vinylbenzyltriethyl ammonium salt, vinylbenzyltripropyl ammonium salt, vinylbenzylmethylamine hydrochloride, methacryloxyethyltrimethyl ammonium salt, methacryloxyethyldimethylethyl ammonium salt, and N,N-dimethylaminoethyl methacrylate hydrochloride; and anionic monomers such as acrylic acid, methacrylic acid, maleic acid, styrenesulfonic acid, and 2-acrylamido-2-methylpropanesulfonic acid or there salts, but the invention is not limited to them.

Typical examples of sparingly-soluble-in-water monomers include olefins such as ethylene, propylene, and 1-butane; styrene or styrene derivatives such as α-methylstyrene, vinyltoluene, chloromethylstyrene, and divinylbenzene; ethylenically-unsaturated esters of organic acids such as vinyl acetate and allyl acetate; esters of ethylenically-unsaturated carboxylic acids such as methyl acrylate, methyl methacrylate, n-butyl acrylate, n-butyl methacrylate, benzyl acrylate, benzyl methacrylate, cyclohexyl acrylate, cyclohexyl methacrylate, and 2-ethylhexyl acrylate; amides of ethylenically-unsaturated carboxylic acids such as N-butylacrylamide, and N-amylacrylamide; dienes such as butadiene isoprene, acrylonitrile; vinyl chloride; and maleic anhydride., although the invention is not limited to them.

Further examples of B are described, for example, by J. Brandrup E. H. Immergut in "Polymer Handbook", second edition (John Wiley & Sons, 1975), VII, pages 1 to 11.

Examples of the substituent in $G^1$ include a halogen atom., a cyano group; an alkyl group; a substituted alkyl group; an alkoxy group; a substituted alkoxy group; —$NHCOR^{46}$, wherein $R^{46}$ represents an alkyl group, a substituted alkyl group, a phenyl group, a substituted phenyl group, an aralkyl group, or a substituted aralkyl group; —$NHSO_2R^{46}$, wherein $R^{46}$ has the same meaning as defined above; —$COOR^{46}$, wherein $R^{46}$ has the same meaning as defined above; —$OCOR^{46}$, wherein $R^{46}$ has the same meaning as defined above; —$SOR^{46}$, wherein $R^{46}$ has the same meaning as defined above;

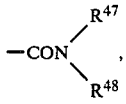

wherein $R^{47}$ and $R^{48}$, which may be the same or different, each represent a hydrogen atom, an alkyl group, a substituted alkyl group, a phenyl group, a substituted phenyl group, an aralkyl group, or a substituted aralkyl group;

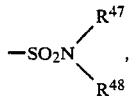

wherein $R^{47}$ and $R^{48}$ have the same meaning as defined above., an amino group, which may be substituted by an alkyl group; a hydroxyl group; and a group that can be hydrolyzed to form a hydroxyl group.

Examples of the substituents of the alkyl group, the substituted alkoxy group, the substituted phenyl group, and the substituted aralkyl group include a hydroxyl group; an alkoxy group having 1 to 4 carbon atoms; —$NHSO_2R^{46}$, wherein $R^{46}$ has the same meaning as defined above; —$NHCOR^{46}$, wherein $R^{46}$ has the same meaning as defined above., —$COOR^{46}$, wherein $R^{46}$ has the same meaning as defined above; —$OCOR^{46}$, wherein $R^{46}$ has the same meaning as defined above,

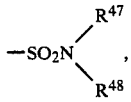

wherein $R^{47}$ and $R^{48}$ have the same meaning as defined above;

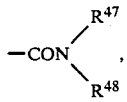

wherein $R^{47}$ and $R^{48}$ have the same meaning as defined above; —$SO_2R^{46}$ wherein $R^{46}$ has the same meaning as defined above; —$COR^{46}$ wherein $R^{46}$ has the same meaning as defined above, a halogen atom, a cyano group; and an amino group that may be substituted by an alkyl group.

Preferable examples of $G^1$ are shown below, but the invention is not limited to them.

| | |
|---|---|
| $C_{10}H_{21}$— | $G^1$-1 |
| $C_{14}H_{29}$— | $G^1$-2 |
| $C_{16}H_{33}$— | $G^1$-3 |
| $C_{20}H_{41}$— | $G^1$-4 |
| $C_8H_{17}OCCH_2$— (‖ O) | $G^1$-5 |
| $C_{18}H_{37}OCCH_2$— (‖ O) | $G^1$-6 |

-continued
$C_{12}H_{25}OC(=O)CH_2CH_2-$ G1-7
$C_{16}H_{33}SO_2NHCH_2CH_2-$ G1-8
$C_8H_{17}CONHCH_2CH_2-$ G1-9
$C_{12}H_{25}-$ G1-10
$C_{15}H_{31}-$ G1-11
$C_{18}H_{37}-$ G1-12
$C_{31}H_{63}-$ G1-13
$C_{12}H_{25}OC(=O)CH_2-$ G1-14
$C_2H_5OC(=O)CH(I)C_{12}H_{25}$ G1-15
$C_{18}H_{37}OC(=O)CH_2CH_2-$ G1-16
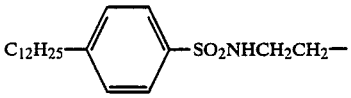
G1-17
$C_{13}H_{27}CONHCH_2CH_2-$ G1-18
$C_{12}H_{25}NHCH_2CH_2-$ G1-19
$C_{12}H_{25}NHCOCH_2-$ G1-20
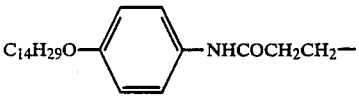
G1-21
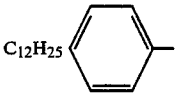
G1-22
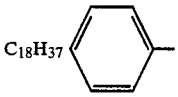
G1-23
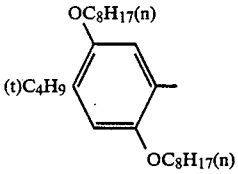
G1-24
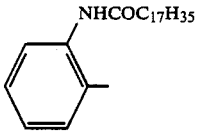
G1-25
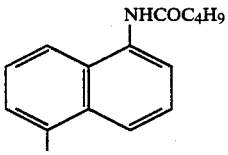
G1-26
$C_{15}H_{31}CONHCH_2CH_2-$ G1-27
-continued
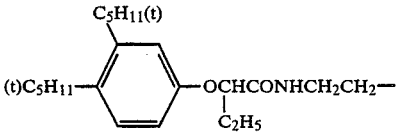
G1-28
$C_8F_{17}CH_2CH_2-$ G1-29
$C_8F_{17}SO_2NHCH_2CH_2-$ G1-30
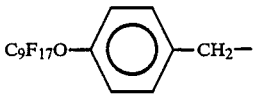
G1-31
$R'fCH_2CH_2OC(=O)CH_2-$ G1-32
$C_{16}H_{33}NHCH_2CH_2-$ G1-33
$C_{18}H_{37}NHCOCH_2-$ G1-34
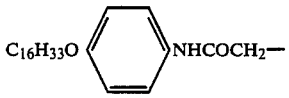
G1 35
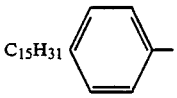
G1-36
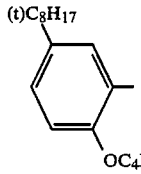
G1-37
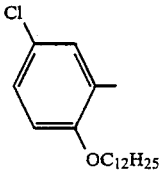
G1-38
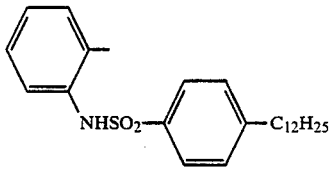
G1-39
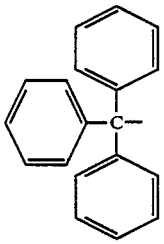
G1-40
$C_{17}H_{25}CONHCH_2CH_2-$ G1-41
$CH_3CON(C_{12}H_{25})CH_2CH_2-$ G1-42
$C_8F_{17}CONHCH_2CH_2-$ G1-43
$C_{12}F_{25}CH_2CH_2OCH_2CH_2-$ G1-44

-continued $C_8F_{17}SO_2N(C_3H_7)CH_2CH_2-$ G1-45

$R'_fCH_2CH_2-$ G1-46

(wherein $R'_f$ represents a mixture of $C_6F_{13}$—, $C_8F_{17}$—, $C_{10}F_{21}$— and $C_{12}F_{25}$— having an average carbon atom number of 9.34.)

In formula (XXV), L represents —O—, —S—, —SO—, or —$SO_2$—, l has the same meaning as defined in formula (III). In formula (II), a monovalent group such as a hydrogen atom and halogen atom (e.g., F, Cl, Br, and I) is preferable as X.

In formula (I), preferably, $x_1$ is 30 to 60 wt. %, y is 2 to 20 wt. %, and z is 20 to 68 wt. %. In formula (II), preferably, $x_2$ is 50 to 80 wt. % and z is 20 to 50%.

Preferred examples of polymer coupler to be used in the present invention are as follows. All the exemplified polymer couplers are water-soluble and lower the surface tension of water to 50 dyne/cm or lower in a $10^{-3}$ wt. % solution at 20° C.

C-1

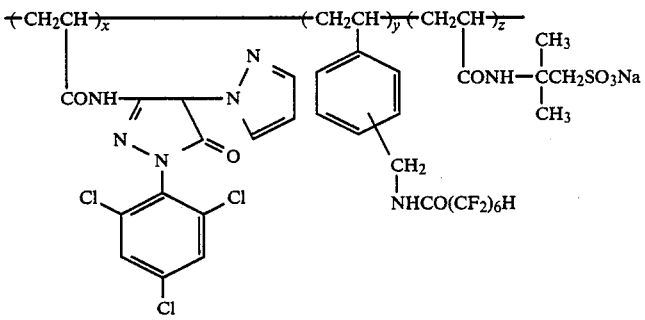

x/y/z = 35/4/61 (wt.)
av. molecular weight: 158,000

C-2

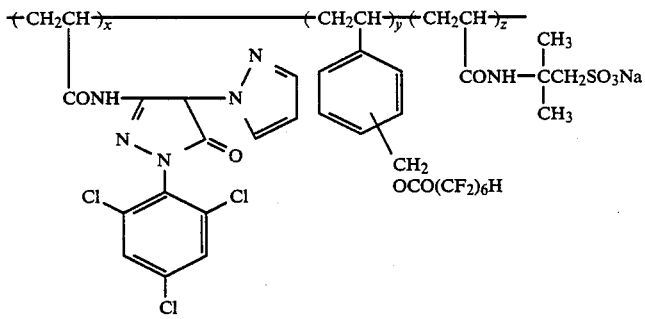

x/y/z = 40/3/57 (wt.)
av. molecular weight: 87,000

C-3

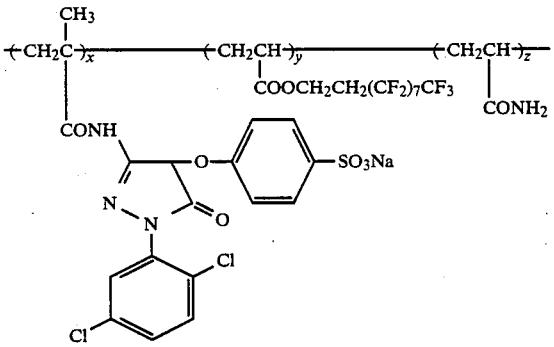

x/y/z = 60/6/34 (wt.)
av. molecular weight: 125,000

C-4

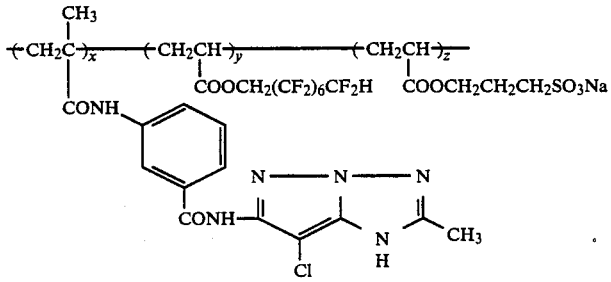

-continued
x/y/z = 45/5/50 (wt.)
av. molecular weight: 120,000
C-5
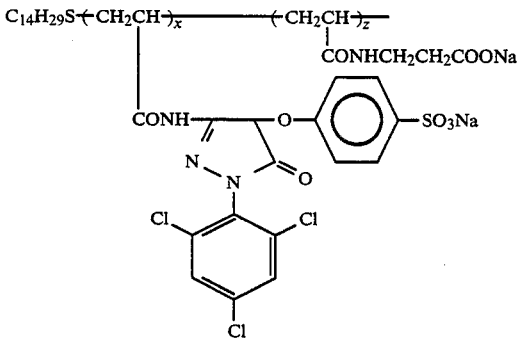
x/z = 50/50 (wt.)
av. molecular weight: 53,000
C-6
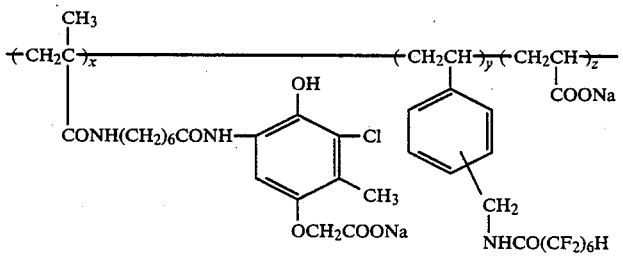
x/y/z = 50/7/43 (wt.)
av. molecular weight: 48,000
C-7
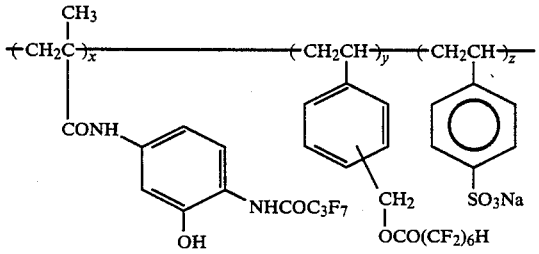
x/y/z = 40/5/55 (wt.)
av. molecular weight: 109,000
C-8
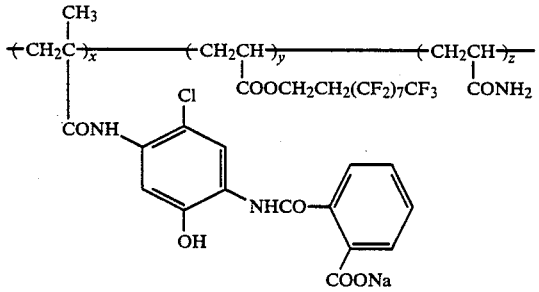
x/y/z = 30/2/68 (wt.)
av. molecular weight: 122,000
C-9
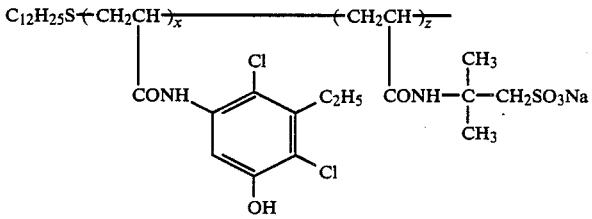
x/z = 60/40 (wt.)
av. molecular weight; 2,800

-continued
C-10
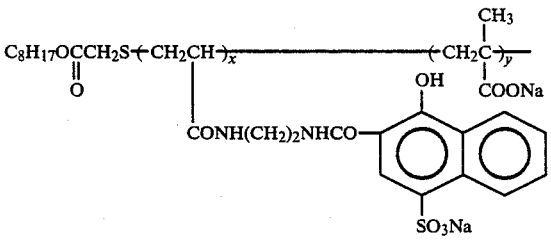
x/z = 75/25 (wt.)
av. molecular weight: 3,300
C-11
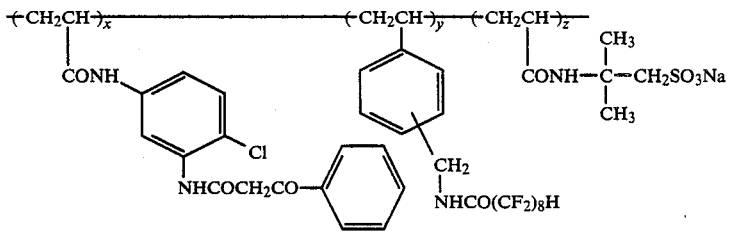
x/y/z = 40/5/55 (wt.)
av. molecular weight: 125,000
C-12
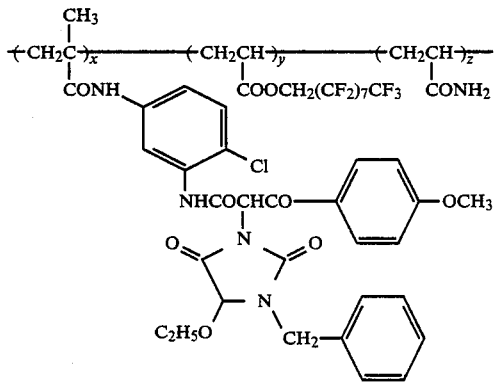
x/y/z = 35/4/61 (wt. %)
av. molecular weight: 101,000
C-13
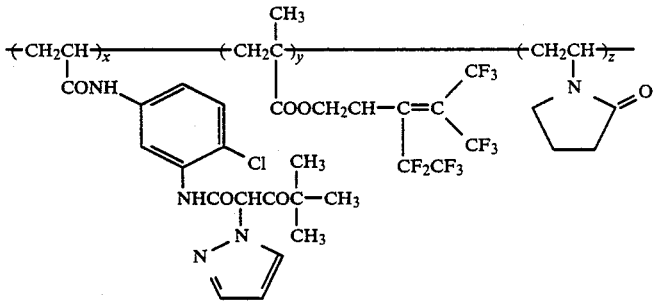
x/y/z = 25/5/70 (wt. %)
av. molecular weight: 57,000

-continued

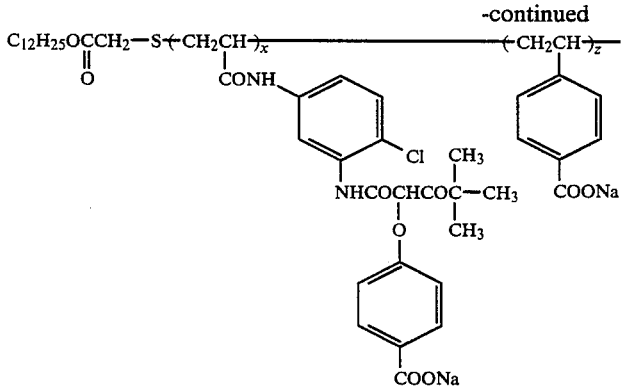

C-14 x/z = 70/30 (wt. %)
av. molecular weight: 3,000

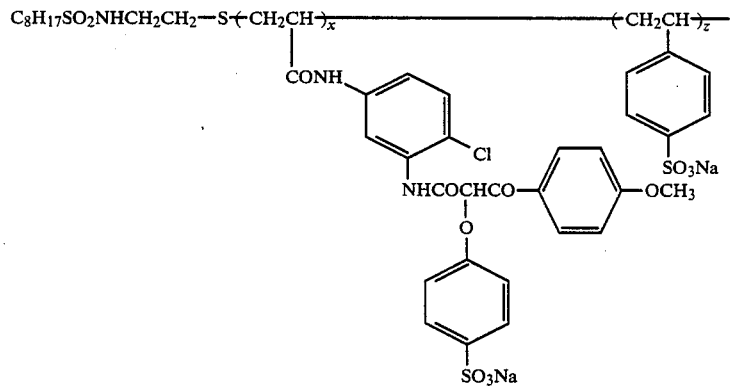

C-15 x/z = 80/20 (wt. %)
av. molecular weight: 3,500

Ethylenically-unsaturated monomers used in synthesizing the polymer couplers of the present invention with a residue that can couple with the oxidized product of an aromatic amine developing agent to form a dye are synthesized by processes described, for example, in Japanese Patent Application (OPI) Nos. 25056/1980, 29805/1980, 62454/1980, 110943/1980, and 94752/1982. Copolymerizable ethylenically-unsaturated monomers with a fluorine-atomcontaining substituent are commercially available, for example, under the trade names Fluorad FC-430 and FC-431, manufactured by 3M company, and Megafac F-171 and F-173, manufactured by Dainippon Ink & Chemicals, Inc.. or they can be synthesized by processes described, for example, in Japanese Patent Application (OPI) Nos. 11342/1982, and 179837/1982.

The polymer couplers of the present invention can be produced by various polymerization processes, such as solution polymerization, precipitation polymerization, suspension polymerization, and bulk polymerization. As an initiating method for polymerization, use can be made of methods using a radical initiator, irradiation with light or radiation, thermal polymerization, etc. These polymerization processes and initiating methods for polymerization are described, for example, by Yoshiji Tsuruta in "Kobunshi Gosei Hanno", revised edition (published by Nikkan Kogyo Shinbunsha, 1971).

Of the above polymerization processes, solution polymerization using a radical initiator is particularly preferable, and solvents used therein are preferably organic solvents high in polarity, such as acetone, N,N-dimethylformamide, N,N-dimethylacetamide, dimethylsulfoxide, methanol, ethanol, 1-propanol, and 2-propanol.

It is necessary to set the polymerization temperature in association with the molecular weight of the polymer to be produced, the type of the initiator used, etc., and although the polymerization temperature may vary from 0° C. or below to 100° C. or above, generally it is in the range of 30° to 100° C.

For use as the radical initiator in polymerization, preferably are, for example, azo-type initiators, such as 2,2'-azobisisobutylonitrile, 2,2'-azobis(2,4-dimethylvaleronitrile), 2,2'-azobis(2-amidinopropane)dihydrochloride, and 4,4'-azobis(4-cyanopentanoic acid), and peroxide-type initiators, such as benzoylperoxide.

The amount of initiator is adjusted in accordance with the molecular weight of the polymer to be produced, and it preferably is in the range of 0.01 to 10 mol %, more preferably 0.01 to 1.0 mol %, for the monomer.

Of the polymer couplers of the present invention, particularly those represented by formula (II) can be synthesized using a chain transfer agent, and they are called telomers.

With respect to the telomers, a detailed description is made by Makoto Ohkawara et al. in "Oligomers" (Kodansha Scientific, 1976), pages 10 to 30.

The synthesis method of the telomers of the present invention is different from the usual radical polymerization, and it is particularly distinguished by the use of a chain transfer agent having about 8 or more carbon atoms. In this case, the polymerization starts and continues via a radical moved to the chain transfer agent, and a telomer is formed by the chain transfer to the chain transfer agent.

Chain transfer agents used are represented by G-X, wherein G and X have the same meaning as defined above, and they include carboxylic acids and their esters, alcohols, thiols, ethers, aldehydes, ketones, halogenated hydrocarbons, aliphatic acid chlorides, halogenated carboxylic acids, etc., as described in the above-mentioned "Oligomers". Of these, alcohols and thiols are particularly preferable.

Since these chain transfer agents range from those high in chain transfer reaction activity to those low in chain transfer reaction activity, as described, for example, by J. Brandrup et al., in "Polymer Handbook" (John Wiley & Sons), II-57 to 102, and by Takayuki Ohtsu "Radical Polymerization (I)" (Kagaku Dojin, 1971), page 128, the amount of chain transfer agent to be added varies depending on the type of agent and the polymerization conditions (e.g., polymerization concentration, the polymerization temperature, and the amount of the initiator). In some cases a chain transfer agent is used in a large amount as a solvent itself, and in some cases a chain transfer agent is used only in an amount of about 1 mol % for a monomer.

Typical Synthesis Examples of the present invention are given below.

A. Synthesis of Ethylenically-Unsaturated Monomers Having a Coupler Residue

Synthesis Example 1 (1)

1-(2,4,6-trichlorophenyl)-3-(3-methacrylamidobenzamido)-4-pyrazolyl-5-oxo-2-pyrazoline (Synthesis of QaM-13)

428 g (1.0 mol) of 1-(2,4,6-trichlorophenyl)-3-(3-nitrobenzamido)-5-oxo-2-pyrazoline was added to 2.2l of dimethylformamide and the mixture was stirred under cooling with ice. Next, 160 g (1.0 mol) of bromine was added dropwise, followed by stirring for about 1 hour. The reaction solution was then poured into 9 l of water, and thereafter the precipitated crystals were filtered to obtain 489.5 g (96.6 %) of 1-(2,4,6-trichlorophenyl)-3-(3-nitrobenzamido)-4-bromo-5-oxo-2-pyrazoline.

Next, 304 g (0.6 mol) of the 1-(2,4,6-trichlorophenyl)-3-(3-nitrobenzamido)-4-bromo-5-oxo-2pyrazoline and 163 g (2.4 mol) of pyrazole were mixed well and then heated to react for about 5 to 6 hours at 80° to 90° C in a stream of nitrogen gas. The mixture was then cooled to room temperature, 700 ml of acetonitrile was added, and the deposited crystals were thereafter filtered to obtain 197 g (66 %) of 1-(2,4,6-trichlorophenyl)-3-(3-nitrobenzamido)-4-pyrazolyl-5-oxo-2-pyrazoline.

Next, 197.5 g (0.4 mol) of the 1-(2,4,6-trichlorophenyl)-3-(3-nitrobenzamido)-4-pyrazolyl-5-oxo-2-pyrazoline was added to 2l of methanol, to which was added a small amount of Raney nickel. Then 120 ml of hydrazine hydrate was slowly added dropwise with heating and stirring, the mixture rcacted for about 1.5 hours, after which the insolubles were filtered out (while the mixture was hot). The filtrate was poured into water, and the deposited crystals were then filtered and washed with methanol to obtain 127.2 g (68%) of 1-(2,4,6-trichlorophenyl)-3-(3-aminobenzamido)-4-pyrazolyl-5-oxo-2-pyrazoline.

Next, 39.5 g (0.08 mol) of the 1-(2,4,6-trichlorophenyl)-3-(3-aminobenzamido)-4-pyrazolyl-5-oxo-2-pyrazoline was dissolved in 800 ml of tetrahydrofuran, and then 16 ml (0.2 mol) of pyridine and 2 ml of nitrobenzene were added. Next, 21 g (0.2 mol) of methacrylic acid chloride was added dropwise while cooling with ice, followed by stirring for 1.5 hours, after which 800 ml of water was added. Extraction with ethyl acetate was carried out. The extract was dried over anhydrous sodium sulfate, the solvent was distilled off under reduced pressure, and the residual oil was dissolved in 250 ml of ethanol. An aqueous solution of 4.8 g (0.12 mol) of sodium hydroxide in 100 ml of water was then added to the solution followed by stirring for 30 min, and then 5 ml of acetic acid was added and the separated oil was crystallized from acetonitrile. Its recrystallization from ethanol was made to obtain 16.4 g (38%) of the title compound. Melting point: 227° to 230° C.

| Elementary analysis ($C_{23}H_{17}N_6O_3Cl_3$) | | | | |
|---|---|---|---|---|
| | H | C | N | Cl |
| Calculated (%) | 3.22 | 51.93 | 15.80 | 20.02 |
| Found (%) | 3.20 | 51.78 | 15.47 | 20.32 |

Synthesis Example (2)

1 (2,4,6-trichlorophenyl)-3-acrylamido-4-pyrazolyl-5-oxo-2-pyrazoline (Synthesis of QaM-16)

27.2 g (0.17 mol) of bromine were slowly added dropwise to a solution of 54.5 g (0.17 mol) of 1-(2,4,6-trichlorophenyl)-3 -acetylamino-5-oxo-2-pyrazoline in 300 ml of acetic acid, followed by stirring for 1 hour. The reaction mixture was then added to 900 ml of water, and the deposited crystals were filtered to obtain 57 g (84%) of 1-(2,4,6-trichlorophenyl)-3-acetylamino-4-bromo-5-oxo-2-pyrazoline.

Next, 57 g (0.15 mol) of the 1-(2,4,6-trichlorophenyl)-3-acetylamino-4-bromo-5-oxo-2-pyrazoline and 41 g of pyrazole (0.6 mol) were mixed well, then heated for 6 hours at 75° C. in a stream of nitrogen gas to react, after which the reaction mixture was cooled to room temperature. Next the reaction mixture was dissolved in ethyl acetate and the solution was washed with water three times and then dried over anhydrous sodium sulfate. The solvent was distilled off under reduced pressure, acetonitrile was added to the residual oil, and the deposited crystals were filtered to obtain 20.1 g (34.7%) of 1-(2,4,6-trichlorophenyl)-3-acetylamino-4-pyrazolyl-5-oxo-2pyrazoline.

Next, 31 g (0.08 mol) of the 1-(2,4,6-trichlorophenyl)-3-acetylamino-4-pyrazolyl-5-oxo-2-pyrazoline in 600 ml of ethanol was heated under reflux while 55 ml of concentrated hydrochloric acid was added. Then, after 1 hour, the reaction mixture was cooled to about 10° C. and neutralized with a solution containing 39 g of potassium hydroxide in 400 ml of methanol. The resulting solution was added to 2.5 l of water to obtain 21.6 g (78%) of 3-amino-1-(2,4,6-trichlorophenyl)-4-pyrazolyl-5-oxo-2-pyrazoline.

Next, 17 g (0.05 mol) of the 3-amino-1-(2,4,6-trichlorophenyl)-4-pyrazolyl-5-oxo-2-pyrazoline was dissolved in 300 ml qf tetrahydrofuran, to which were added 10 ml (0.13 mol) of pyridine and 1 ml of nitrobenzene. Then, 31.1 g (0.12 mol) of acrylic acid chloride was added under cooling with ice, after which the mixture was stirred for 1.5 hours. Next, 500 ml of water was added, extraction with ethyl acetate was effected, and the extract was dried over anhydrous sodium sulfate. The solvent was distilled off under reduced pressure, the residual oil was dissolved in 150 ml of ethanol, and then 60 ml of water containing 3.0 g (0.074 mol) of sodium hydroxide was added at room temperature. After being stirred for 30 min, 3 ml of acetic acid was added to neutralize the solution, the separated oil was extracted with ethyl acetate, the extract was dried over anhydrous sodium sulfate, and the solvent was distilled off under reduced pressure. The residual oil was purified by silica gel column chromatography to yield 6.4 g (32%) of the title compound. Melting point: 151° to 154° C.

| | Elementary analysis ($C_{15}H_{10}N_5O_2Cl_3$) | | | |
|---|---|---|---|---|
| | H | C | N | Cl |
| Calculated (%) | 2.53 | 45.15 | 17.55 | 26.66 |
| Found (%) | 2.48 | 45.01 | 17.49 | 26.30 |

B. Synthesis of Ethylenically-Unsaturated Monomers Having a Fluorine-Containing Substituent Synthesis Example (3)

Synthesis of Monomer Example (AM-1). 2,2,3,3,4,4,5,5,6,6,7,7-dodecafluoro-n-heptanoic acid vinylbenzyl ester 289.3 g (0.836 mol) of 2,2,3,3,4,4,5,5,6,6,7,7-dodecafluoro-n-heptanoic acid was charged into a 500-ml three-neckcd flask equipped with a stirrer, a reflux condenser, and a calcium chloride tube, and it was then cooled with ice water. 149.2 g (0.836×1.5 mol) of thionyl chloride was poured in, with gentle stirring. Further, 3.3 g (0.836×0.05 mol) of pyridine was gradually added dropwise. Next, the external temperature was heated to 100° C., and the reaction mixture was stirred for 4 hours. Then, after cooling, the deposited needle crystals and pale yellow solid were filtered off, the remaining thionyl chloride was distilled off, and the produced chloride of a fluorocarboxylic acid was purified by distillation under normal pressures. Thus, 280.3 g (yield: 92.0%, b.p.=131° to 133° C.) of 2,2,3,3,4,4,5,5,6,6,7,7-dodecafluoro-nheptanoic acid chloride was obtained.

100 ml of diethyl ether, 40.2 g (0.3 mol) of vinylbenzylalcohol (synthesized by the method described in "Polymer", 14 330 (1973) from chloromethylstyrene (meta: para=about 6: about 4); b.p.=69° to 73° C./0.4 mm Hg), 30.3 g (0.3 mol) of triethylamine, and 0.5 g of 2,6-di-tbutylphenol were charged into a 300-ml three-necked flask equipped with a stirrer, a reflux condenser, and a calcium chloride tube, and the mixture was then cooled with ice-water. 109.4 g (0.3 mol) of the 2,2,3,3,4,4,5,5,6,6,7,7-dodecafluoro-n-heptanoic acid chloride synthesized above was cooled with ice and was added to the mixture dropwise, with stirring. Next the mixture was stirred for 2 hours at room temperature, after which it was stirred for 1 hour under reflux. Then, after cooling, the deposited triethylamine hydrochloride was filtered off, the filtrate was washed twice with water, then with an aqueous sodium carbonate solution, and then it was dried over anhydrous sodium carbonate. Distillation was carried out twice to purify the dried filtrate, thus giving 61.0 g (yield: 44.0%; b.p.: 106 to 116° C./0.9 mm Hg; d: 1.47) of 2,2,3,3,4,4,5,5,6,6,7,7-dodecafluoro-n-heptanoic acid vinylbenzyl ester.

Synthesis Example (4)

Synthesis of Monomer Example (AM-4), 2,2,3,3,4,4,5,5,6,6,7.7-dodecafluoro-n-heptanoic acid vinylbenzylamide 300 ml of acetonitrile, 33.9 g (0.3 mol) of vinylbenzylamine (synthesized by the method described in "Kobunshi Gakkai Yokoshu", vol. 26, page 834 (G3 C-07) (1977) from chloromethylstyrene (meta:para=-about 6:4); p.b.: 82° C./1.5 mm Hg), 30.3 g (0.3 mol) of triethylamine, and 0.5 g of 2,6-di-t-butylphenol were charged into a 500-ml three-necked flask equipped with a stirrer, and a calcium chloride tube, and the mixture was then cooled with ice water. 109.5 g (0.3 mol) of the 2,2,3,3,4,4,5,5,6,6,7,7-dodecafluoro-n-heptanoic acid chloride synthesized in Synthesis Example 1 was added dropwise, with stirring and ice-cooling. Next, the mixture was stirred for 1 hour at room temperature, and the deposited triethylamine hydrochloride was filtered off. The filtrate was distilled under reduced pressure to remove the acetonitrile, 200 ml of ethyl acetate was added to the remainder to be dissolved, and white insolubles were filtered off. The filtrate was distilled under reduced pressure to be condensed, and 300 ml of n-hexane was added to the remainder, followed by cooling. The deposited white crystals were filtered and dried in vacuo at room temperature, thus producing 90.1 g (yield: 65.2%; m.p.: 53° to 57° C.) of 2,2,3,3,4,4,5,5,6,6,7,7-dodecafluoro-n-heptanoic acid vinylbenzylamide.

C. Synthesis of Polymer Couplers

Synthesis Example (5)

Synthesis of (C-1), poly[1-(2,4,6-trichlorophenyl)-3-acrylamido-4-pyrazolyl-5-oxo-2-pyrazoline-co-2,2,3,3,4,4,5,5,6,6,7,7-dodecafluoro-n-heptanoic acid vinylbenzylamido-co-2-acrylamido-2-methylpropanesulfonic acid sodium salt]

11.9 g of 1-(2,4,6-trichlorophenyl)-3-acrylamido-4-pyrazolyl-5-oxo-2-pyrazolone (QaM-16), 1.4 g of 2,2,3,3,4,4,5,5,6,6,7,7-dodecafluoro-n-heptanoic acid vinylbenzylamide (AM-4), 20.7 g of 2-acrylamido-2methylpropanesulfonic acid sodium salt, 60 ml of DMF, 60 ml of methanol, and 12 ml of 5N aqueous sodium hydroxide solution were charged into a 300-ml reactor. Next the atmosphere in the reactor was replaced with nitrogen gas, the mixture was heated to 60° C., and 0.175 g of 2,2'-azobisisobutylonitrile was added, followed by heating for 4 hours. After cooling the reaction mixture to room temperature, 600 ml of acetone was added, and the precipitate was filtered and dried in vacuo to produce 21.6 g (yield: 62%) of the intended polymer.

Synthesis Example (6)

Synthesis of Telomer C-9

12 g of 5-acrylamido-2,4-dichloro-3-methylphenol (QaM-1) 8 g of 2-acrylamido-2-methylpropanesulfonic acid sodium salt, 1.0 g of n-dodecylmercaptane, and 100 ml of ethanol were charged into a 200-ml three-necked flask and were heated to 75° C. in a stream of nitrogen, with stirring. 5 ml of a solution containing 0.21 g of dimethyl azobisisobutyrate was added to the mixture, and the resulting mixture was stirred for 5 hours at a constant temperature of 75° C. After being cooled to room temperature, 600 ml of acetone was added to the reaction mixture, and the precipitate was filtered and dried in vacuo to produce 19.5 g of the title telomer C-9.

The term "water-soluble" in this specification and claims means that the particular polymer coupler can be dissolved in water in an amount of 1.0 wt. % or more. In view of production, it is preferable that the polymer coupler can be dissolved in water in an amount of 10 wt. % or more.

The polymer coupler of the present invention lowers the surface tension of water to preferably 50 dyne/cm or lower in a 10−wt. % solution at 20° C.

The polymer couplers of the present invention can be added as an aqueous solution to a coating liquid, or they can be dissolved in a solvent mixture of water and an organic solvent miscible with water to be added to a coating liquid such as a lower alcohol, THF, acetone, and ethyl acetate.

The polymer couplers of the present invention can also be dissolved in an aqueous alkali solution or an organic solvent mixture containing an alkali and water to be added to a coating liquid. Further, the polymer couplers of the present invention may be dispersed in a gelatin solution, and a small amount of a surface-active agent may be added additionally.

In any case, it is considered that the water-soluble polymer coupler of the present invention is not in the form of oil-droplets or a latex in the coating liquid or in the coated film but that it interacts with the hydrophilic binder, and thereby they solubilize each other to a certain degree.

Therefore, it is considered that the strength of the film using the polymer coupler of the present invention exhibits excellent performance in comparison with using oil-soluble polymer couplers (including polymer couplers in the form of a latex).

The polymer couplers of the present invention may be, as shown in compound examples, 4-equivalent color couplers, whose coupling active position is a hydrogen atom, or 2-equivalent color couplers, whose coupling active position is substituted with a coupling-off group, though for 2- equivalent color couplers the amount of silver to be applied can be reduced and a higher sensitivity can be obtaincd. It is possible to design a structure such that the colored dye may have a suitable diffusibility or that a compound useful in improving the quality of an image, such as a developmcnt retarder, a development accelerator, and a photographic dye, may be released along with the coupling reaction.

The polymer coupler of the present invention is added to a silver halide emulsion layer or its adjacent layer. When the polymer coupler of the invention is used in a layer containing a silver halide, it is desirable that the polymer coupler is added in an amount of 0.005 to 0.5 mol, preferably 0.01 to 0.10 mol per mol of silver, in terms of an ethylenically-unsaturated monomer unit having a coupler residue (Qa in formulas (I) and (II)).

Molecular weight of the polymer coupler of the present invention is preferably in the range of 10,000 to 100,000, more preferably 20,000 to 500,000, particularly in the case of telomer coupler, molecular weight is preferably in the range of 1,000 to 10,000, more preferably 1,000 to 5,000.

When the polymer coupler of the present invention is used in a non-photosensitive layer, it is desirable that the amount of the polymer coupler to be applied is in the range of 0.01 to 1.0 g/m$^2$, preferably 0.1 to 0.5 g/m$^2$.

In the present invention, two or more polymer couplers represented by formulas (I) and (II) can be used in the same layer, and the same polymer coupler can be contained in different two layers.

To introduce the polymer coupler of the present invention into a silver halide emulsion layer, it is added as an aqueous solution into a silver halide emulsion followed by application.

Using the polymer coupler of the present invention it is possible to produce a color photographic material and a black and white photographic material based on a dye image by selecting such factors that the coupler will give neutral gray. In the production of such photographic materials, it is desirable that all couplers required for forming dye images, such as cyan couplers, magenta couplers, yellow couplers, and couplers that will release compounds useful for improving the quality of an image by a coupling reaction, arc photographic couplers according to the invention. But it is also possible that part of them is replaced by couplers having a long-chain aliphatic group that will be emulsified and dispersed using a high-boiling organic solvent, or polymerized couplers, in which case they are used in combination with the photographic couplers of the present invention.

The gelatin to which the polymer coupler of the present invention will be applied may be any one of the so-called alkali-treated gelatins (lime-processed gelatins), obtained by immersion into an alkali bath before the extraction of gelatin during its production; acid-treated gelatin, obtained by immersion into an acid bath; doubleimmersion gelatin, obtained by immersion into an alkali bath and an acid bath; and enzyme-processed gelatin. Further, the hardener of the present invention may be applied to gelatin having a low molecular weight obtained by heating the above gelatin in a water bath or allowing a proteolytic enzyme to act on the above gelatin, which action thereby partially hydrolyzes the gelatin.

Although it is advantageous to use gelatin, as a binder or a protective colloid that can be used in the emulsion layer or an intermediate layer of the photographic material of the present invention, other synthetic binders can also be used.

The silver halide emulsion of the color photographic material to be used in this invention may be any type of halogen composition, including silver bromide, silver iodobromide, silver bromochloroiodide, silver chlorobromide or silver chloride.

The silver halide grains of the silver halide emulsion may be regular grains comprising regular crystals such as cubes, octahedrons, or tetradecahedrons, or irregular crystals such as spherical crystals or plate-like crystals, crystals having defects such as twin planes, or composites thereof.

The grain diameter of the silver halide may be fine grains about 0.2 μm or less, or coarse grains wherein the diameter of the projected area is about 10 μm, and a polydisperse emulsion or a monodisperse emulsion can be used.

The silver halide photographic emulsions that can be used in this invention may be prepared suitably by known means, for example by the methods described in "I. Emulsion Preparation and Types" in *Research Disclosure* (RD), No. 17643 (December 1978), pp. 22–23, and in RD. No. 18716 (November 1979) p. 648; the methods described in P. Glafkides "Chemie et Phisique Photographique", Paul Montel (1967), in G. F. Duffin "Photographic Emulsion Chemistry", Focal Press (1966), and in V. L. Zelikman et al. "Making and Coating of Photographic Emulsion", Forcal Press (1964).

A monodisperse emulsion, such as described in U.S. Pat. Nos. 3,574,628 and 3,655,394, and in British Pat. No. 1,413,748, is also preferable.

Tabular grains having an aspect ratio of 5 or greater can be used in the emulsion of the present invention. Tabular grains can be easily prepared by the methods described in Gutoff "Photographic Science and Engineering", Vol. 14, pp. 248–257 (1970), U.S. Pat. Nos. 4,434,226, 4,414,310, 4,433,048, and 4,439,520, and British Pat. No. 2,112,157.

The crystal structure of the emulsion grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Further, the silver halide may be a mixture of grains having various crystal shapes.

The silver halide emulsion may generally be physically ripened chemically ripened, and spectrally sensitized. Additives that will be used in these steps are described in *Research Disclosure* No. 17643 and ibid.No. 18716, and the involved sections are listed in the Table below.

Known photographic additives that can be used in this invention are also described in the above-mentioned two Research Disclosures, and the involved sections are listed in the same Table below.

| | Additive | RD 17643 | RD 18716 |
|---|---|---|---|
| 1 | Chemical sensitizer | p. 23 | p. 648 (right column) |
| 2 | Sensitivity-enhancing agents | — | " |
| 3 | Spectral sensitizers and Supersensitizers | pp. 23–24 | pp. 648 (right column) -649 (right column) |
| 4 | Brightening agents | p. 24 | — |
| 5 | Antifogging agents and Stabilizers | pp. 24–25 | p. 649 (right column) |
| 6 | Light absorbers, Filter dyes, and UV Absorbers | pp. 25–26 | pp. 649 (right column) -650 (left column) |
| 7 | Stain-preventing agents | p. 25 (right column) | p. 650 (left to right column) |
| 8 | Image dye stabilizers | p. 25 | — |
| 9 | Hardeners | p. 26 | p. 651 (left column) |
| 10 | Binders | p. 26 | " |
| 11 | Plasticizers and Lubricants | p. 27 | p. 650 (right column) |
| 12 | Coating aids and Surface-active agents | pp. 26–27 | " |
| 13 | Antistatic agents | p. 27 | " |

Various conventional color couplers can be used in this invention, and typical examples are described in the patents in the above-mentioned *Research Disclosure* No. 17643, VII-C - G.

As yellow couplers, those described, for example, in U.S. Pat. Nos. 3,933,501, 4,022,620, 4,326,024, and 4,401,752, Japanese Patent Publication No. 10739/1983, and British Pat. Nos. 1,425,020 and 1,476,760 are preferable.

As magenta couplers, the 5-pyrazolone type and pyrazoloazole type are preferable, and those described in U.S. Pat. Nos. 4,310,619 and 4,351,897, European Pat. No. 73,636, U.S. Pat. Nos. 3,061,432 and 3,725,067, *Research Disclosure* No. 24220 (June 1984), Japanese Patent Application (OPI) No. 33552/1985, *Research Disclosure* No. 24230 (1984), Japanese Patent Application (OPI) No. 43659/1985, and U.S. Pat. Nos. 4,500,630 and 4,540,654 are more preferable.

The cyan couplers that can be used in this invention include phenol-type couplers and naphthol-type couplers,and those described in U.S. Pat. Nos. 4,052,212, 4,146,396, 4,228,233, 4,296.200, 2,369,929, 2,801,171, 2,772,162, 2,895,826, 3,772,002, 3,758,308, 4,334,011, and 4,327,173, German Patent Application (OLS) No. 3,329,729, European Pat. No. 121,365A, U.S. Pat. Nos. 3,446,622, 4,333,999, 4,451,559, and 4,427,767, and European Pat. No. 161,626A are more preferable.

As a colored coupler to rectify the unnecessary absorption of color-forming dyes, those couplers described in paragraph VII-G of *Research Disclosure* No. 17643, U.S. Pat. No. 4,163,670, Japanese Patent Publication No. 39413/1982, U.S. Pat. Nos. 4,004,929 and 4,138,258, and British Pat. No. 1,146,368 can be preferably used in the present invention.

As a coupler which forms a dye having moderate diffusibility, those described in U.S. Pat. No. 4,366,237, British Pat. No. 2,125,570, European Pat. No. 96,570, and German Patent Application (OLS) No. 3,234,533 are preferable.

Examples of a polymerized dye-forming coupler are described in U.S. Pat. Nos. 3,451,820, 4,080,211, and 4,367,282, and British Pat. No. 2,102,173.

A coupler that releases a photographically useful residue can be used favorably in this invention. As a DIR coupler that releases a development retarder, those described in Japanese Patent Application (OPI) Nos. 151944/1982, 154234/1982, and 184248/1985, and U.S. Pat. No. 4,248,962, which are cited in paragraph VII-F of the above-mentioned *Research Disclosure* No. 17643, are preferable.

As a coupler which releases, imagewise, a nucleating agent or a development accelerator upon developing, those described in British Patent Nos. 2,097,140, 2,131,188, and Japanese Patent Application (OPI) No. 157638/1984, and 170840/1984 are preferable.

Other couplers that can be incorporated in the photographic material of this invention include competitive couplers described in U.S. Pat. No. 4,130,427, multiequivalent couplers described in U.S. Pat. Nos. 4,283,472, 4,338,393, and 4,310,618, DIR couplers which release a redox compound, as described in Japanese Patent Application (OPI) No. 185950/1985, and couplers which release a dye to regain a color after releasing, as described in European Patent No. 173,302A.

The pH of the washing water used in processing the photographic materials of the present invention is 4 to 9, preferably 5 to 8. Although the washing water temperature and the washing time can depend on the properties of the photographic material, its application, etc., generally the washing water temperature and the washing time are 15 to 45° C. and 20 sec to 10 min, preferably 25° to 40° C. and 30 sec to 5 min.

Further, the photographic material of the present invention can be processed by using, instead of the washing mentioned above, a stabilizing solution directly. In such stabilizing processing, all known methods described, for example, in Japanese Patent Application (OPI) Nos. 8543/1982, 14834/1983, 184343/1984, 220345/1985, 238832/1985, 239784/1985, 239749/1985, 4054/1986, and 118749/1986 can be used. Particularly preferable is a stabilizing bath containing 1-hydroxyethylidene-1,1-diphosphonic acid, 5-chloro-2-methyl-4-isothiazolin-3-one, a bismuth compound, an ammonium compound, or the like.

Subsequent to the washing processing mentioned above, in some cases stabilizing processing is carried out. For example, a stabilizing bath containing formaldehyde and a surface-active agent is used as a final bath for a color photographic material.

According to the silver halide color photographic materials of the present invention, because couplers are sufficiently made fast to diffusion, colors can be prevented from mixing and the color reproduction of a photographic image can be enhanced. Also, in the silver halide color photographic materials of the present invention, since it is not required to use high-boiling organic solvents and the coupler-containing layer is hardly softened, the thickness of the coupler-containing layer can be reduced, improving the sharpness of the dye image.

Next, the present invention will be described in detail in accordance with examples, but it should be understood that these examples are not intended to limit the scope of the invention.

EXAMPLE 1

Photosensitive materials (Samples 101 to 106) consisting of layers of the following composition were prepared on an undercoated triacetate cellulose film base.

| (Sample 101) | Coating amount |
|---|---|
| (1) Emulsion layer | |
| Negative-type silver iodobromide emulsion (silver iodide: 4 mol % average grain size: 0.6 μm) | 0.79 g/m$^2$ |
| Gelatin | 1.5 g/m$^2$ |
| Coupler Cp-1 (per mol of silver) | 0.1 mol |
| Oil for dispersion Oil-1 (per gram of coupler) | 1 g |
| (2) Protective layer | |
| Gelatin layer containing poly(methyl methacrylate) particles (diameter: about 1.5 μm) | 1.1 g/m$^2$ |

The gelatin hardener H-1 and a surface-active agent were added to each layer.

(Samples 102 to 106)

Samples 102 was prepared by coating the composition prepared by excluding the oil for dispersion from that of Sample 101. Samples 103 to 106 were prepared by repeating the same procedure as Sample 102, except that coupler Cp-1 was respectively changed at equal mol to the comparative coupler Cp-2 and couplers M-1, M-3, and M-4 of the present invention.

The couplers and the oil for dispersion used in the emulsion layer are shown below.

Cp-1

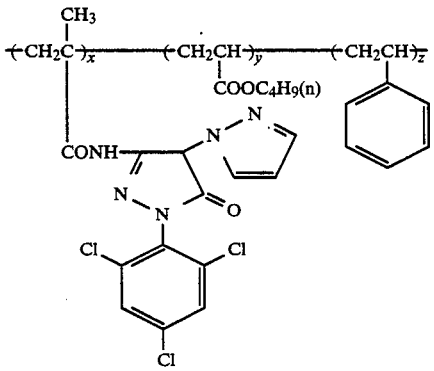

x/y/z = 50/25/25 (weight ratio)
av. molecular weight:40,000

Cp-2

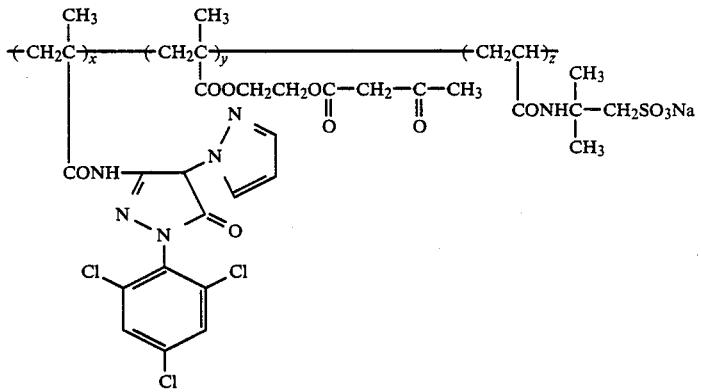

x/y/z = 50/10/40 (weight ratio)
av. molecular weight:80,000
Oil for dispersion Oil-1 Tricresyl phosphate Each of the thus-prepared photographic samples was subjected to a light exposure from a Wolfram light source, at a color temperature of 4,800° K. through a filter, so that the maximum exposure amount might be 25 CMS, and it was then subjected to development processing at 38° C. according to the following process.

| | |
|---|---|
| Color developing | 3 min. 15 sec. |
| Bleaching | 6 min. 30 sec. |
| Water washing | 2 min. 10 sec. |
| Fixing | 4 min. 20 sec. |
| Water washing | 3 min. 15 sec. |
| Stabilizing | 1 min. 05 sec. |

The composition of each processing solution was as follows:

| Color Developing Solution | |
|---|---|
| Diethylenetriaminetetraacetate | 1.0 g |
| 1-Hydroxyethylidene-1,1-diphosphate | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-β-hydroxyethylamino)-2-methylaniline sulfonate | 4.5 g |
| Water to make | 1000 ml |
| | pH 10.0 |
| Bleaching Solution | |
| Iron (III) ammonium ethylenediamine-tetraacetate | 100.0 g |
| Disodium ethylenediamine-tetraacetate | 10.0 g |
| Ammonium bromide | 150.0 g |
| Ammonium nitrate | 10.0 g |
| Water to make | 1000 ml |
| | pH 6.0 |
| Fixing Solution | |
| Disodium ethylenediamine-tetraacetate | 1.0 g |
| Sodium sulfite | 4.0 g |
| Ammonium thiosulfite (70%) | 175.0 ml |
| Sodium hydrogensulfite | 4.6 g |
| Water to make | 1000 ml |
| | pH 6.6 |
| Stabilizing Solution | |
| Formalin (40%) | 2.0 ml |
| Polyoxyethylene-p-monononylphenyl ether (average polymerization degree: 10) | 0.3 g |
| Water to make | 1000 ml |

The thus-obtained results concerning the photographic property are shown in Table 1.

TABLE 1

| Sample | Coupler | Fogging | Relative Sensitivity* | Max. Color Density |
|---|---|---|---|---|
| 101 (Comparative example) | Cp-1 | 0.05 | 100 | 1.81 |
| 102 (Comparative example | Cp-1 | 0.04 | 86 | 1.25 |
| 103 (Comparative example) | Cp-2 | 0.03 | 78 | 0.86 |
| 104 (This invention) | C-1 | 0.05 | 103 | 2.01 |
| 105 (This invention | C-3 | 0.05 | 101 | 1.94 |
| 106 (This invention) | C-5 | 0.05 | 101 | 1.91 |

TABLE 1-continued

*The relative value of the sensitivity shown by a reciprocal of the exposure amount of light resulting in + 0.2 of fogging compared to Sample 101 as 100.

As is apparent from the results in Table 1, the relative sensitivity and the maximum color density of each sample using a coupler of the present invention, which can lower surface tension, are equal to the results using a lipophilic polymer coupler incorporated with an oil for dispersion which has enough nondiffusibility. Accordingly, the polymer coupler of the invention has enough nondiffusibility to be fixed in a gelatin layer, despite of being provided with water-solubility.

From the results of Samples 102, 104, 105, and 106 it can be seen that the polymer coupler of the present invention is useful in making the photographic material thinner because of the high maximum color density even without an oil for dispersion, although the decrement of maximum color density is remarkable when using a lipophilic polymer coupler Cp-1 without incorporating the oil for dispersion.

Further, from the results of Samples 103, 104, 105 and 106 it can be seen that there is little diffusion of the couplers of the present invention from the gelatin layers, thus showing higher relative sensitivity and higher maximum color density. On the contrary the conventional water soluble coupler Cp-2 diffused markedly from the gelatin layer, lowering both the relative sensitivity and the maximum color density.

EXAMPLE 2

A multi-layer color photosensitive material (Sample 201) consisting of layers of the following composition was prepared on an undercoated triacetate cellulose film base.

(Composition of photosensitive layers)

In the following compositions, the coating amount of silver halide and colloidal silver are each indicated in g/m$^2$ in terms of silver, the coating amount of the coupler, additive, and gelatin are each indicated in g/m$^2$, and the coating amount of the sensitizing dye is indicated in mol per mol of silver halide.

| | |
|---|---|
| First layer: Antihalation layer | |
| Black colloidal silver | 0.2 |
| Gelatin | 1.3 |
| Colored coupler CC-1 | 0.06 |
| UV absorber UV-1 | 0.1 |
| UV absorber UV-1 | 0.2 |
| Oil for dispersion Oil-1 | 0.01 |
| Oil for dispersion Oil-2 | 0.01 |
| Second layer: Intermediate layer | |
| Fine-grain silver bromide emulsion (average grain size: 0.07 μm) | 0.15 |
| Gelatin | 0.1 |
| Colored coupler CC-2 | 0.02 |
| Oil for dispersion Oil-1 | 0.1 |
| Third layer: First red-sensitive emulsion layer | |
| Silver iodobromide emulsion (silver iodide: 2 mol %, average grain size: 0.3 μm) | silver: 0.4 |
| Gelatin | 0.6 |
| Sensitizing dye I | $3.0 \times 10^{-4}$ |
| Sensitizing dye II | $3.0 \times 10^{-4}$ |
| Sensitizing dye III | $1 \times 10^{-5}$ |
| Coupler CC-3 | 0.06 |

-continued

| | |
|---|---|
| Coupler CC-4 | 0.06 |
| Coupler CC-8 | 0.04 |
| Coupler CC-2 | 0.03 |
| Oil for dispersion Oil-1 | 0.03 |
| Oil for dispersion Oil-3 | 0.012 |
| Fourth layer: Second red-sensitive emulsion layer | |
| Silver iodobromide emulsion (silver iodide: 5 mol %, average grain size: 0.5 μm) | silver: 0.7 |
| Sensitizing dye I | $1 \times 10^{-4}$ |
| Sensitizing dye II | $3 \times 10^{-4}$ |
| Sensitizing dye III | $1 \times 10^{-5}$ |
| Coupler CC-3 | 0.24 |
| Coupler CC-4 | 0.24 |
| Coupler CC-8 | 0.04 |
| Coupler CC-2 | 0.04 |
| Oil for dispersion Oil-1 | 0.05 |
| Oil for dispersion Oil-3 | 0.10 |
| Fifth layer: Third red-sensitive emulsion layer | |
| Silver iodobromide emulsion (silver iodide: 10 mol %, average grain size: 0.7 μm) | silver: 1.0 |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler CC-6 | 0.05 |
| Coupler CC-7 | 0.1 |
| Coupler CC-2 | 0.03 |
| Oil for dispersion Oil-1 | 0.01 |
| Oil for dispersion Oil-2 | 0.05 |
| Sixth layer: Intermediate layer | |
| Gelatin | 1.0 |
| Compound Cpd-A | 0.03 |
| Oil for dispersion Oil-1 | 0.05 |
| Oil for dispersion Oil-2 | 0.05 |
| Seventh layer: First green-sensitive emulsion layer | |
| Silver iodobromide emulsion (silver iodide: 4 mol %, average grain size: 0.3 μm) | silver: 0.30 |
| Sensitizing dye IV | $5 \times 10^{-4}$ |
| Sensitizing dye V | $2 \times 10^{-4}$ |
| Gelatin | 1.0 |
| Coupler Cp-1 | 0.2 |
| Coupler CC-5 | 0.03 |
| Coupler CC-1 | 0.03 |
| Oil for dispersion Oil-1 | 0.5 |
| Eighth layer: Second green-sensitive emulsion layer | |
| Silver iodobromide emulsion (silver iodide: 5 mol %, average grain size: 0.5 μm) | silver: 0.4 |
| Sensitizing dye VI | $5 \times 10^{-4}$ |
| Sensitizing dye V | $2 \times 10^{-4}$ |
| Gelatin | 1.0 |
| Coupler Cp-1 | 0.25 |
| Coupler CC-1 | 0.03 |
| Coupler CC-10 | 0.015 |
| Coupler CC-5 | 0.03 |
| Oil for dispersion Oil-1 | 0.2 |

-continued

| | |
|---|---|
| Ninth layer: Third green-sensitive emulsion layer | |
| Monodisperse silver iodobromide emulsion (silver iodide: 6 mol %, average grain size: 0.7 μm) | silver: 0.85 |
| Gelatin | 1.0 |
| Sensitizing dye IV | $3.5 \times 10^{-4}$ |
| Sensitizing dye V | $1.4 \times 10^{-4}$ |
| Coupler CC-11 | 0.05 |
| Coupler CC-12 | 0.01 |
| Coupler CC-13 | 0.08 |
| Coupler CC-1 | 0.02 |
| Coupler CC-15 | 0.02 |
| Oil for dispersion Oil-1 | 0.10 |
| Oil for dispersion Oil-2 | 0.05 |
| Tenth layer: Yellow filter layer | |
| Gelatin | 1.2 |
| Yellow colloidal silver | 0.08 |
| Compound Cpd-B | 0.1 |
| Oil for dispersion Oil-1 | 0.3 |
| Eleventh layer: First blue-sensitive emulsion layer | |
| Monodisperse silver iodobrbmide emulsion (silver iodide: 4 mol %, average grain size: 0.3 μm) | silver: 0.4 |
| Gelatin | 1.0 |
| Sensitizing dye V | $2 \times 10^{-4}$ |
| Coupler CC-14 | 0.9 |
| Coupler CC-5 | 0.07 |
| Oil for dispersion Oil-1 | 0.2 |
| Twelfth layer: Second blue-sensitive emulsion layer | |
| Silver iodobromide emulsion (silver iodide: 10 mol %, average grain size: 1.5 μm) | silver: 0.5 |
| Gelatin | 0.6 |
| Sensitizing dye V | $1 \times 10^{-4}$ |
| Coupler CC-14 | 0.25 |
| Oil for dispersion Oil-1 | 0.07 |
| Thirteenth layer: First protective layer | |
| Gelatin | 0.8 |
| UV absorber UV-1 | 0.1 |
| UV absorber UV-2 | 0.2 |
| Oil for dispersion Oil-1 | 0.01 |
| Oil for dispersion Oil-2 | 0.01 |
| Fourteenth layer: Second protective layer | |
| Fine-grain silver bromide emulsion (average grain size: 0.07 μm) | 0.5 |
| Gelatin | 0.45 |
| Poly(methyl methacrylate) particles (particle diameter: 1.5 μm) | 0.2 |
| Formaldehyde scavenger S-1 | 0.5 |
| Formaldehyde scavenger S-2 | 0.5 |

In each layer described above, a surface-active agent was added as a coating aid. The thus-prepared sample is called Sample 201.

The chemical structure or name of the compounds used in the present invention are shown hereinbelow.

UV

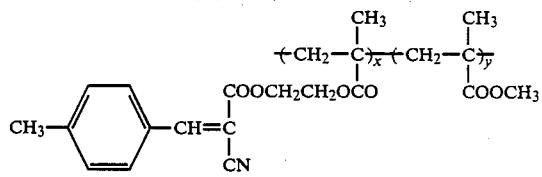

x/y = 7/3 (in wt. ratio)

UV

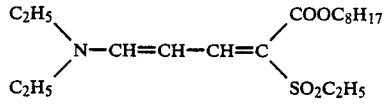

Oil - 1 Tricresyl phosphate
Oil - 2 Dibutyl phthalate
Oil - 3 Bis(2-ethylhexyl)phthalate -continued
CC-1
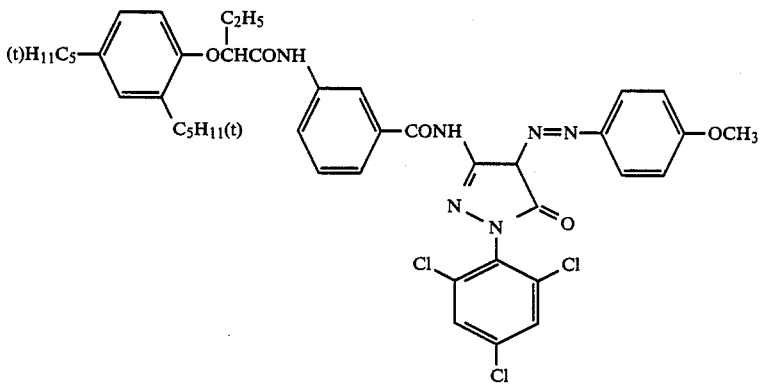
CC-2
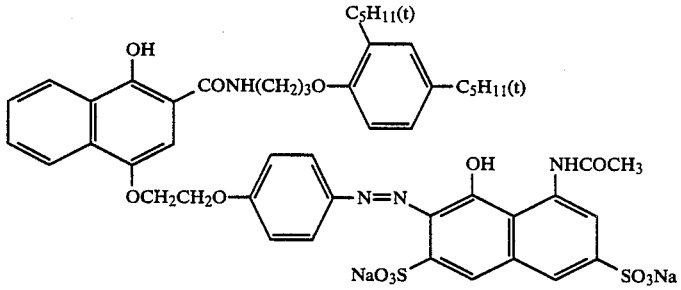
CC-3
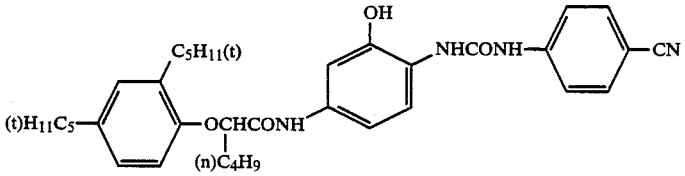
CC-4
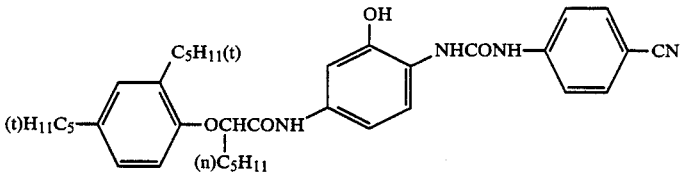
CC-5
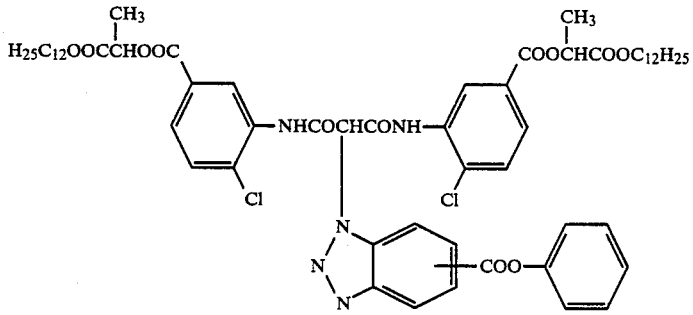

-continued
CC-6
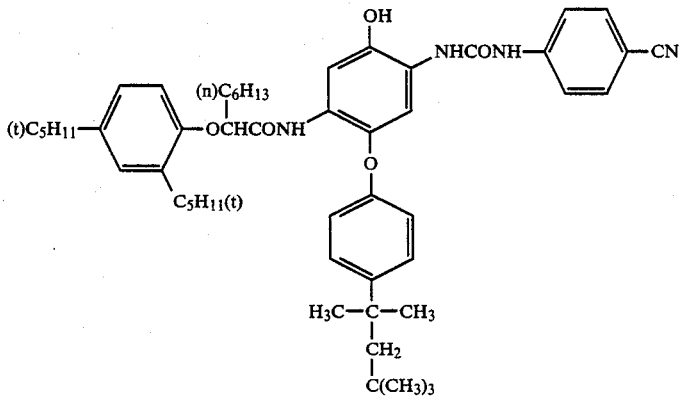
CC-7
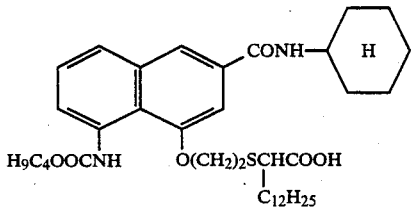
CC-8
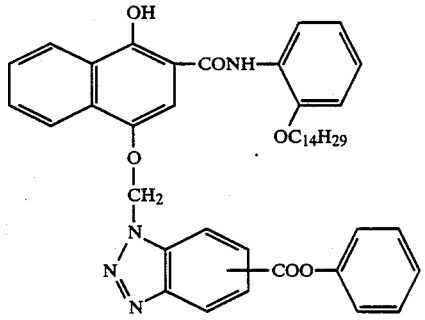
CC-10
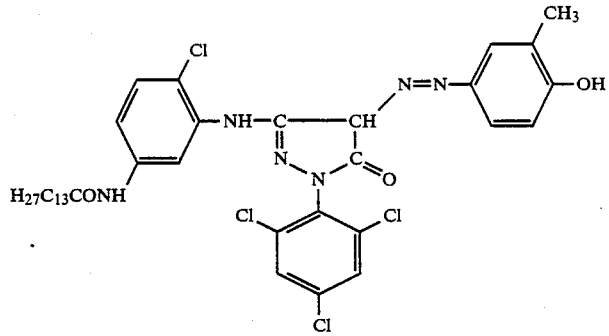
CC-11
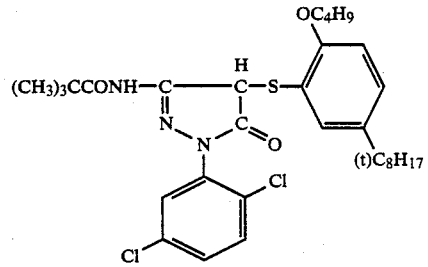

-continued
CC-12
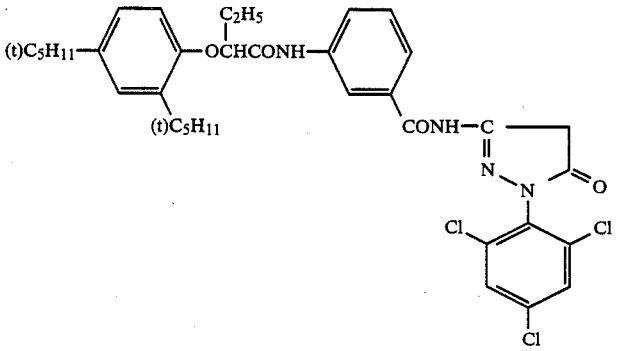
CC-13
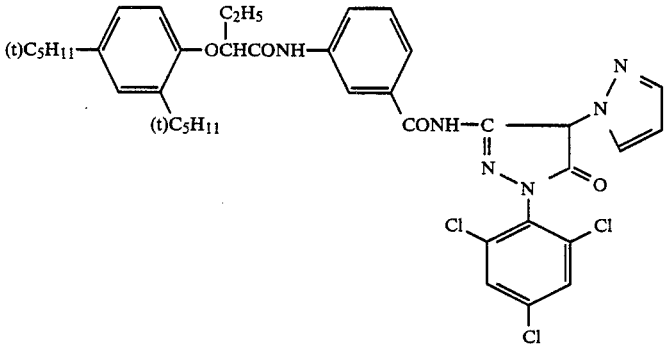
CC-14
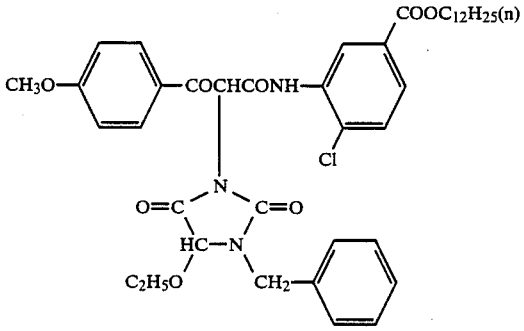
CC-15
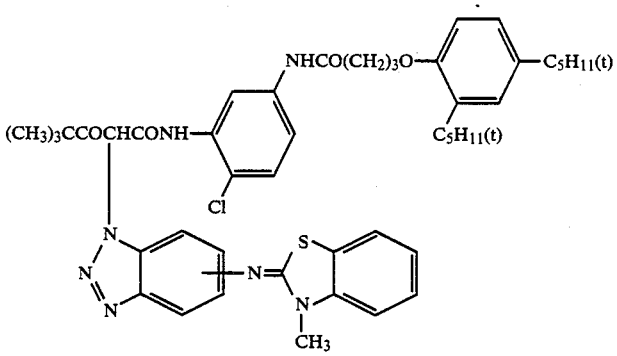

-continued
Cp-3
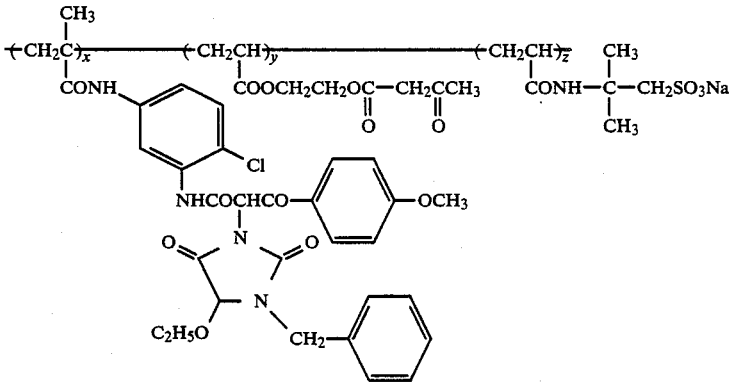
x/y/z = 55/10/35
av. molecular weight: 86,000
Cpd-A
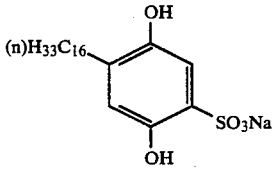
Cpd-B
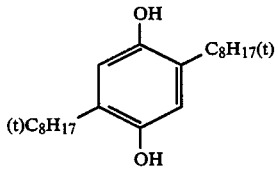
Sensitizing dye I
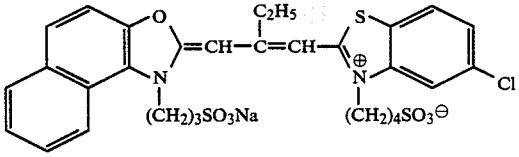
Sensitizing dye II
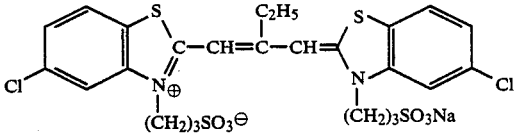
Sensitizing dye III
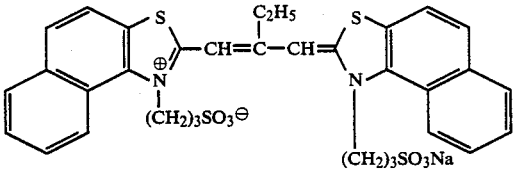
Sensitizing dye IV
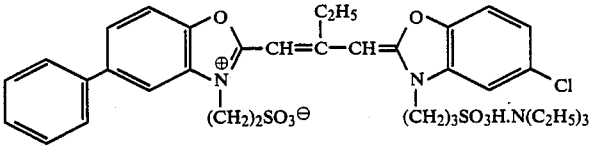

-continued

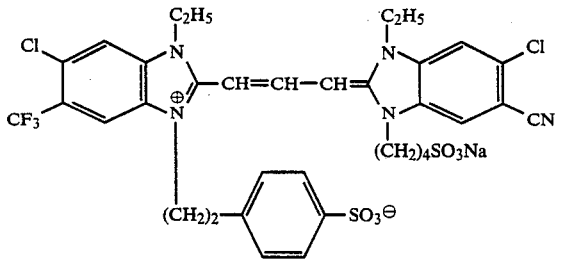

Sensitizing dye V

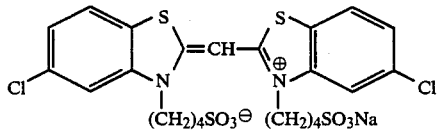

Sensitizing dye VI

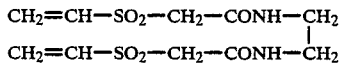

HT-1

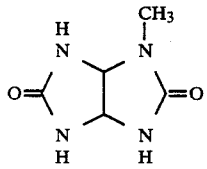

S-1

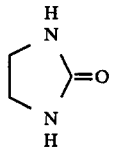

S-2

(Samples 202 to 205)

Samples 202 to 205 were prepared by repeating the same procedure as Sample 201, except that the coupler CC-14 and the oil for dispersion Oil-1 in the 11th layer and the 12th layer of Sample 201 were changed to those shown respectively in Table 2.

TABLE 2

| | Eleventh Layer Coating Amount (g/m²) | | | Twelfth Layer Coating Amount (g/m²) | | |
|---|---|---|---|---|---|---|
| Sample | Coupler | Gelatin | Oil for Dispersion | Coupler | Gelatin | Oil for Dispersion |
| 201 | CC-14 | 1.0 | 0.2 | CC-14 | 0.6 | 0.07 |
| 202 | CP-3 | 1.0 | 0.05 | CP-3 | 0.6 | 0 |
| 203 | C-12 | 0.5 | 0 | C-12 | 0.3 | 0 |
| 204 | C-14 | 0.5 | 0 | C-14 | 0.3 | 0 |
| 205 | C-15 | 0.5 | 0 | C-1 | 0.3 | 0 |

Each of the thus-prepared Samples 201 to 205 was subjected to the same light exposure for sensimetry as Example 1, and to a light exposure for an MTF measurement. Thereafter, the samples were subjected to the same color development processing as Example 1. The results concerning the photographic property are shown in Table 3.

The MTF-values were obtained according to the method described in T. H. James, "The Theory of the Photographic Process", 4th Ed., page 605, Macmillan (1977).

TABLE 3

| Sample | Coupler in 11th & 12th Layers | Relative Sensitivity* | MTF at Red-sensitive 5c/mm | MTF at Red-sensitive 50/mm |
|---|---|---|---|---|
| 201 (Comparative example) | CC-14 | 100 | 1.12 | 0.38 |
| 202 (Comparative example) | CP-3 | 81 | 1.17 | 0.40 |
| 203 (This invention) | C-12 | 104 | 1.24 | 0.45 |
| 204 (This invention) | C-14 | 108 | 1.26 | 0.46 |
| 205 (This invention) | C-15 | 103 | 1.25 | 0.45 |

*The relative value of the sensitivity shown by a reciprocal of the exposure amount of light resulting in + 0.2 of fogging compared to Sample 201 as 100.

The above results show that the relative sensitivity of a multilayered system using the photogrpahic couplers of the present invention is similar to that of Example 1 using a single-layered system, higher than that of hitherto known water-soluble couplers, and equal to or higher than that of hydrophobic low-molecular couplers that are dispersed using a dispersing oil.

Table 3 shows that in comparison with the hydrophobic low-molecular coupler dispersed using a dispersing oil, with the photographic couplers of the present invention the MTF values and the sharpness are enhanced. Therefore, it is clear that a polymer coupler of the present invention is adequately fast to diffusion to be secured in a gelatin layer in which it is dispersed, and that the coupler is useful in providing silver halide color photographic materials with improved sharpness.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide photographic material which comprises, as a photographic color coupler, a watersoluble polymer coupler that can couple with the oxidized product of an aromatic primary amine developing agent to form a dye, and said coupler has the ability to lower the surface tension of water, wherein the polymer coupler is selected from those with repeating units represented by the following formula (I) or those represented by the following formula (II):

$$\text{-}(Qa)_{x_1}(A)_y(B)_z\text{-} \quad (I)$$

$$G\text{-}(Qa)_{x_2}(B)_z\text{-}X \quad (II)$$

wherein Qa represents an ethylenically-unsaturated monomer unit having a coupler residue that can couple with the oxidized product of an aromatic primary amine developing agent, A represents a monomer unit derived from a copolymerizable ethylenically-unsaturated monomer that has a fluorine-atom-containing substituent; B represents a monomer unit derived from a copolymerizable ethylenically-unsaturated monomer; $x_1$ is 10 to 98 wt. %, $x_2$ is 10 to 100 wt. %, y is 2 to 80 wt. %, and z is 0 to 80 wt. %.; A and B do not include a coupler residue; X represents a monovalent group; and G in formula (II) is represented by the following formula (XXV):

$$G^1\text{—}L\text{-}_l \quad (XXV)$$

wherein $G^1$ is an alkyl group, a substituted alkyl group, a substituted aryl group, and a substituted naphthyl group, each having 8 or more carbon atoms;

L represents —O—, —S—, —SO—, or —$SO_2$—, and l is 0 or 1.

2. The silver halide photographic material as claimed in claim 1, wherein Qa in formulas (I) and (II) represents a unit derived from, a monomer represented by the following formula (III):

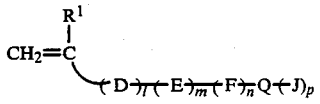

wherein $R^1$ represents a hydrogen atom, a chlorine atom, or an alkyl group having 1 to 4 carbon atoms; D represents —COO—, —CONR'—, or a substituted or unsubstituted phenyl group; E represents a substituted or unsubstituted alkylene group, phenylene group, or aralkylene group; F represents —CONR'—, —NR'—CONR'—, —NR'COO—, —NR'CO—, —OCONR'—, —NR'—, —COO—, —OCO—, —CO—, —O—, —$SO_2$—, —NR'$SO_2$—, or —$SO_2$NR'—, in which R' represents a hydrogen atom or a substituted or unsubstituted aliphatic group or aryl group, and if two or more R' are present in the same molecule, they may be the same or different;

l, m, and n are 0 or 1, provided that l, m and n are not 0 at the same time;

J represents a hydrophilic group;

p is 0, 1 or 3; and

Q represents a cyan, magenta or yellow dye-forming coupler residue capable of coupling with the oxidized product of an aromatic primary amine developing agent to form a dye.

3. The silver halide photographic material as claimed in claim 2, wherein the color coupler residue represented by Q in formula (III) is selected from those represented by phenol type (IV) or (VI), or naphthol type (V) or (VII) in which a hydrogen atom other than one positioned at the coupling position or the 1-positioned OH group will split off to join with F or J of formula (III)

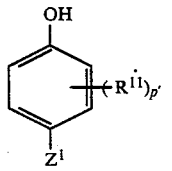

(IV)

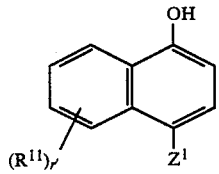

(V)

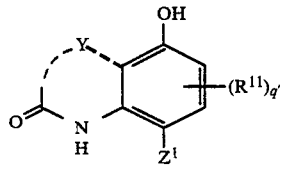

(VI)

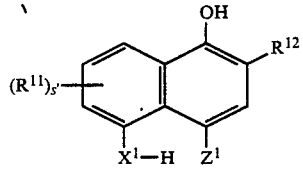

(VII)

wherein $R^{11}$ represents a group capable of substitution onto a phenol ring or a naphthol ring;

$R^{12}$ represents —$CONR^{13}R^{14}$, —$NHCOR^{13}$, —$NHCOOR^{15}$, —$NHSO_2R^{15}$, —$NHCONR^{13}R^{14}$, or —$NHSO_2R^{13}R^{14}$, in which $R^{13}$ or $R^{14}$ represents a hydrogen atom, an aliphatic, an aromatic group, a heterocyclic group, $R^{15}$ represents an aliphatic group, an aromatic group, or a heterocyclic group, $R^{13}$ and $R^{14}$ may bond together to form a heterocyclic ring;

p' is an integer of 0 to 3, q' is an integer of 0 to 2, r' and s' are each integers of 0 to 4;

$X^1$ represents an oxygen atom, a sulfur atom, or $R^{16}N<$, in which $R^{16}$ represents a hydrogen atom or a monovalent substituent;

$Z^1$ represents a hydrogen atom, or a group that can split off by coupling reaction; and Y represents a group or atoms required to form a 5-, 6- or 7-membered ring together with the carbon atom.

4. The silver halide photographic material as claimed in claim 2, wherein the color forming coupler residue represented by the following formulas (VIII), (IX), (X), (XI), (XII), (XIII), and (XIV), and connected to D, E or F of formula (111) at a part of Ar, $Z^2$, and $R^{20}$ to $R^{32}$ Formula (VIII)

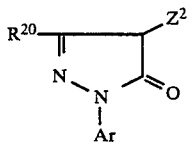

Formula (IX)

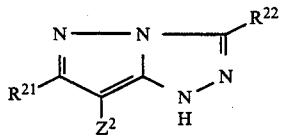

Formula (X)

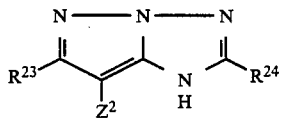

Formula (XI)

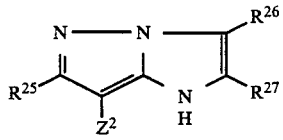

Formula (XII)

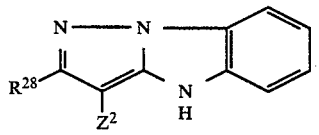

Formula (XIII)

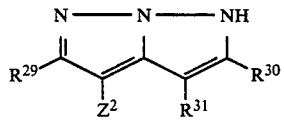

Formula (XIV)

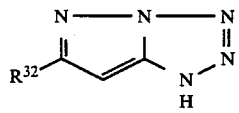

wherein

Ar represents a substituent capable of substitution at the first position of a 2-pyrazoline-5-one coupler;

$R^{20}$ represents an unsubstituted or substituted anilino group, an unsubstituted or substituted acylamino group, or an unsubstituted or substituted ureido group;

$R^{21}$, $R^{22}$, $R^{23}$, $R^{24}$, $R^{25}$, $R^{26}$, $R^{27}$, $R^{28}$, $R^{29}$, $R^{30}$, $R^{31}$ and $R^{32}$ each represent a hydrogen atom, hydroxyl group, unsubstituted or substituted alkyl group, unsubstituted or substituted aryl group, unsubstituted or substituted heterocyclic group, alkylamino group, acylamino group, anilino group, alkoxycarbonyl group, alkylcarbonyl group, arylcarbonyl group, alkylthio group, arylthio group, carbamoyl group, sulfamoyl group, or sulfonamido group; and $Z^2$ represents a hydrogen atom or a group which can split-off upon a coupling-reaction.

5. The silver halide photographic material as claimed in claim 2, wherein the color coupler residue represented by Q in formula (111) is selected from those represented by formulas (XV) and (XVI) and connected to F or J in the above-mentioned formula (III) at a point of $Z^3$, $R^{33}$, $R^{34}$, $R^{35}$ or $R^{36}$ (XV)

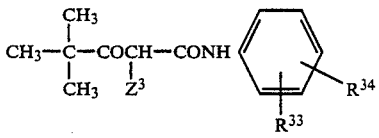

(XVI)

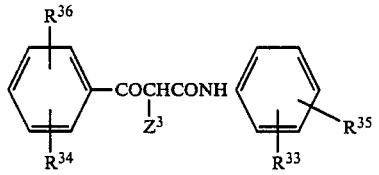

wherein $R^{33}$, $R^{34}$, $R^{35}$, and $R^{36}$, which may be the same or different, each represent a hydrogen atom or a substituent, and $Z^3$ represents a hydrogen atom or a group that can split off upon a coupling reaction.

6. The silver halide photographic material as claimed in claim 1, wherein A represents a monomer unit derived from monomer represented by the following formula (XXIV):

(XXIV)

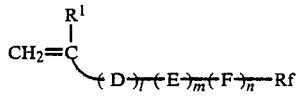

wherein

R' represents a hydrogen atom, a chlorine atom, or an alkyl group having 1 to 4 carbon atoms; D represents —COO—, —CONR'—, or a substituted or unsubstituted phenyl group; E represents a substituted or unsubstituted alkylene group, phenylene group, or aralkylene group; F represents —CONR'—, —NR'—CONR'—, —NR'COO—, —NR'CO—, —OCONR'—, —NR'—, —COO—, —OCO—, —CO—, —O—, —$SO_2$, —NR'$SO_2$—, or —SOzNR'—, in which R' represents a hydrogen atom or a substituted or unsubstituted aliphatic group or aryl group, and if two or more R' are present in the same molecule, they may be the same or different;

l, m, and n are 0 or 1, provided that l, m and n are not 0 at the same time;

and Rf represents an alkyl group, an aralkyl group, an aryl group, or an alkylaryl group, each having 1 to 30 carbon atoms and being replaced at least one of the hydrogen atoms with a fluorine atom.

7. The silver halide photographic material as claimed in claim 1, wherein in formulas (I) and (II), B is a monomer unit derived from a water-soluble monomer selected from the group consisting of nonionic monomer selected from acrylamide, methacrylamide, N-methylolacrylamide, N,N-dimethylaminoethylacrylamide, N,N-dimethylaminopropyl-acrylamide, hydroxyethyl methacrylate, N,N-dimethyl-aminoethyl acrylate, N,N-dimethylaminoethyl methacrylate, poly(ethyleneoxy)acrylate, poly(ethyleneoxy)methacrylate, 2-vinylpyridine, 4-vinylpyridine, 1-vinyl-2-pyrrolidone, 1-vinylimidazole, and 1-vinyl-2-methylimidazole; cationic monomer selected from vinylbenzyltrimethylammonium salt, vinylbenzyltriethyl-ammonium salt, vinylbenzyltripropylammonium salt, vinylbenzylmethylamine hydrochloride, methacryloxyethyltrimethylammonium salt, methacryloxyethyl-dimethylethylammonium salt, and N,N-dimethylaminoethyl methacrylate hydrochloride; and anionic monomers selected from acrylic acid, methacrylic acid, maleic acid, styrenesulfonic acid, and 2-acrylamido-2-methylpropanesulfonic acid or there salts.

8. The silver halide photographic material as claimed in claim 1, wherein X in formula (II) is a hydrogen atom or halogen atom.

9. The silver halide photographic material as claimed in claim 1, wherein the polymer coupler lowers the surface tension of water to 50 dyne/cm or lower in an aqueous solution at 20° C.

10. The silver halide photographic material as claimed in claim 1, wherein the ethylenically-unsaturated monomer in Qa in formulas (I) and (II) is selected from QaM-3

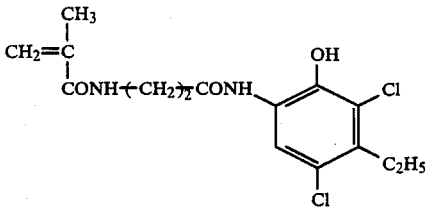

QaM-4

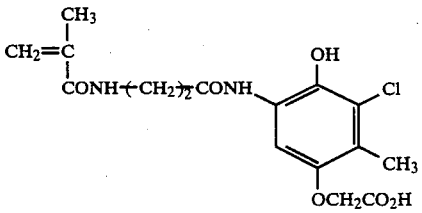

QaM-16

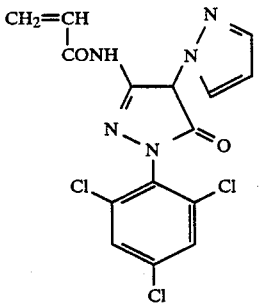

QaM-18

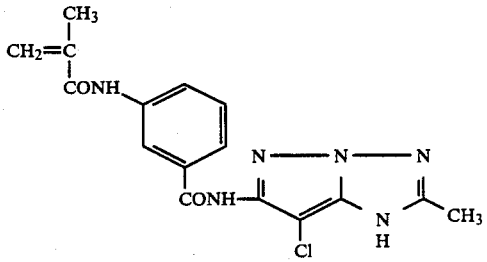

-continued

QaM-21

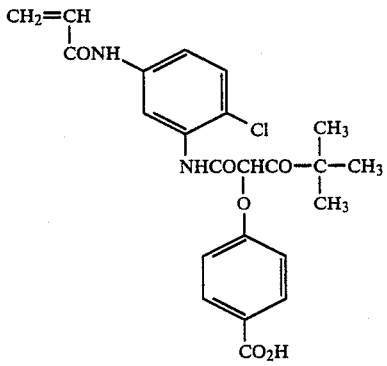

and

QaM-28

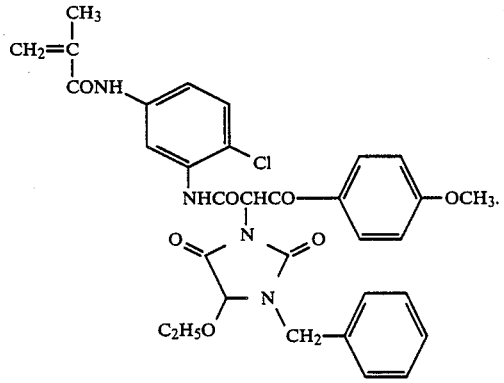

11. The silver halide photographic material as claimed in claim 6, wherein the monomer represented by formula (XXIV) is selected from

AM-1

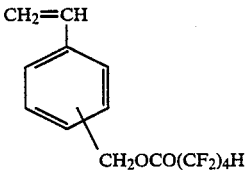

AM-4

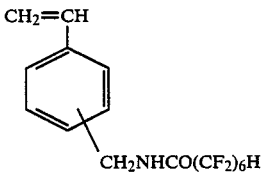

and

AM-29

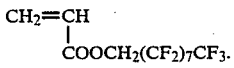

12. The silver halide photographic material as claimed in claim 1, wherein G in formula (II) is an alkylthio group.

13. The silver halide material as claimed in claim 2, wherein J represents a hydrophilic group selected from —COOM, —$SO_2$M, —O—$SO_3$M or

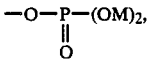

where M represents a hydrogen atom or an inorganic or organic cation.

* * * * *